US007163350B2

(12) United States Patent
Noguchi et al.

(10) Patent No.: US 7,163,350 B2
(45) Date of Patent: Jan. 16, 2007

(54) LIQUID CONTAINER

(75) Inventors: Yoshio Noguchi, Kawagoe (JP); Hidehei Kageyama, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 249 days.

(21) Appl. No.: 10/716,620

(22) Filed: Nov. 20, 2003

(65) Prior Publication Data

US 2004/0161291 A1 Aug. 19, 2004

(30) Foreign Application Priority Data

Nov. 21, 2002 (JP) ..... 2002-337975
Oct. 24, 2003 (JP) ..... 2003-365048

(51) Int. Cl.
*B43K 5/02* (2006.01)

(52) U.S. Cl. ..... 401/224; 401/223; 401/225; 401/227

(58) Field of Classification Search ..... 401/198, 401/199, 202, 221–230, 242, 243, 247
See application file for complete search history.

(56) References Cited

U.S. PATENT DOCUMENTS 3,442,597 A 5/1969 Hebborn et al.
4,556,336 A 12/1985 Sano et al.
5,172,995 A * 12/1992 Felgentreu ..... 401/217
5,551,789 A 9/1996 Okawa et al.
6,062,758 A * 5/2000 Maurer et al. ..... 401/199
6,474,894 B1 * 11/2002 Baik ..... 401/223

FOREIGN PATENT DOCUMENTS

DE 34 42 331 A1 5/1986
EP 0 256 615 A1 2/1988

OTHER PUBLICATIONS

European Search Report dated Mar. 9, 2004.

* cited by examiner

*Primary Examiner*—Tuan Nguyen
(74) *Attorney, Agent, or Firm*—McGinn IP Law Group PLLC

(57) ABSTRACT

In a liquid container, it is made possible to store liquid that is overflowed by fluctuations in atmospheric pressure and thereby to prevent liquid leaks, and the whole quantity of the stored liquid is enabled to be used. The liquid container is provided with a body having a main tank in which liquid is stored; a supply outlet, located toward the tip of the body, for supplying the liquid; a guiding portion connecting the main tank and the supply outlet to guide the liquid from the main tank to the supply outlet; and a liquid reservoir having an air flow port communicating with the exterior and a liquid flow port communicating with the main tank or the guiding portion and an overflowing liquid flow path for storing liquid overflowing the main tank. The liquid is stored farther away from the supply outlet than the liquid flow port.

19 Claims, 26 Drawing Sheets

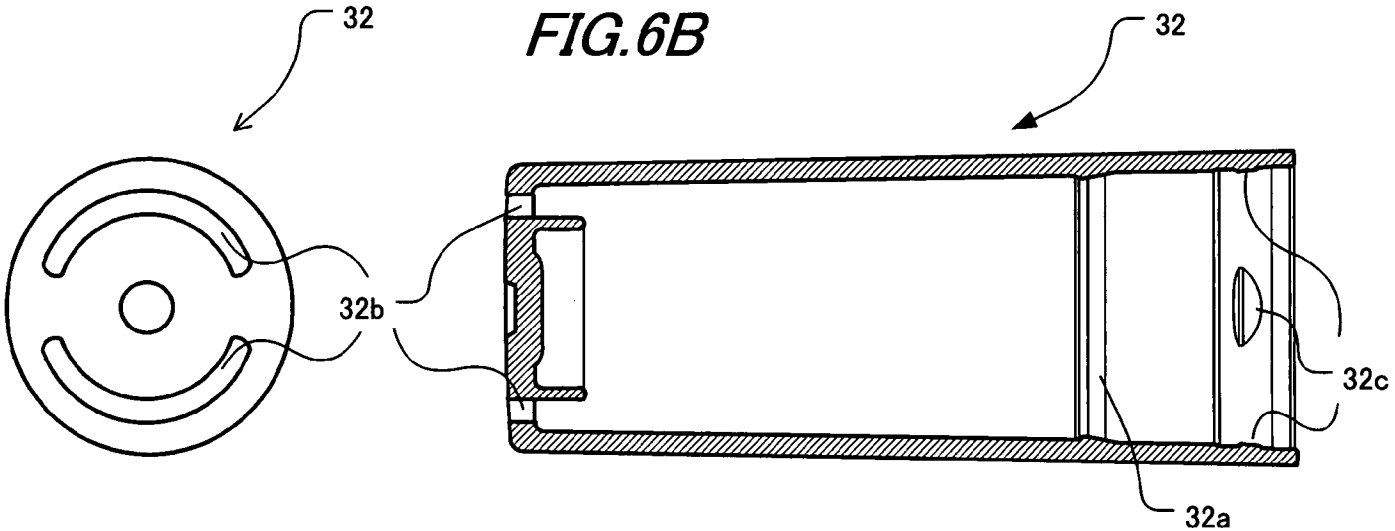
FIG.6B
FIG.6A
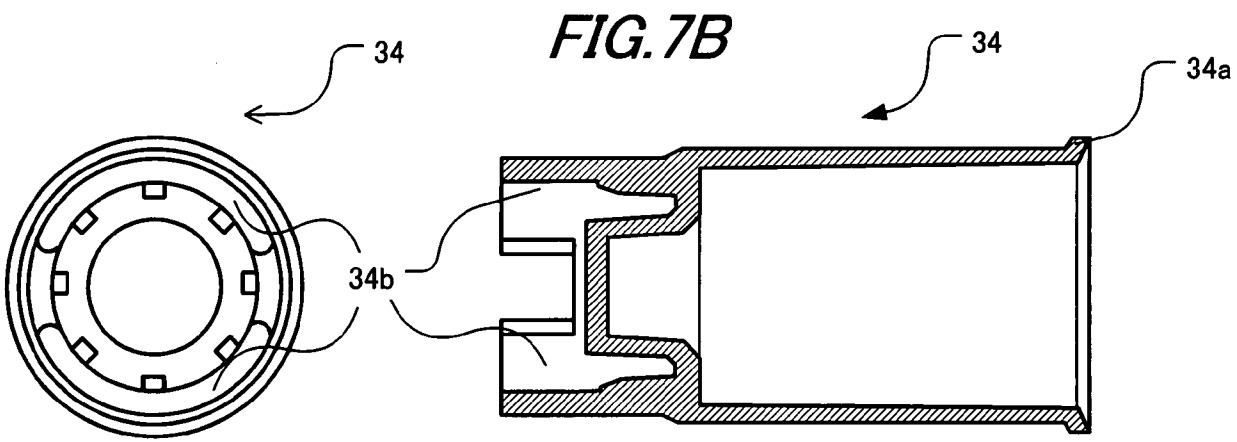
FIG.7B
FIG.7A

LIQUID CONTAINER

BACKGROUND OF THE INVENTION

1. Field of the Invention

The present invention relates to a liquid container having a liquid reservoir for temporarily storing liquid.

2. Description of the Related Art

Conventional liquid containers of this kind involve a problem that the expansion of air due to the pressure difference between the external atmosphere and the inside among other factors causes the stored liquid to drop from the liquid supply outlet, and there are known many different liquid containers each provided with a liquid reservoir to avoid this problem (as disclosed in, for instance, the Japanese Utility Model Laid-Open No. 5-2989 and the International Publication No. WO97/12765).

The liquid reservoir has a reservoir tank consisting of grooves formed like combs, and the reservoir tank is arranged outside the guiding portion in the direction of its outer diameter separated from the guiding portion, the guiding portion connecting a main tank and the supply outlet. The rear end of the liquid reservoir has a liquid flow port communicating with the main tank, while the fore end of the liquid reservoir has an air flow port communicating with the outside.

In the liquid container described above, the liquid having overflowed the main tank as a result of a rise in internal air pressure passes the liquid flow port, settles in the reservoir tank consisting of comb-like grooves and, when the air pressure returns to its previous level, returns from the reservoir tank into the main tank via the liquid flow port. However, the whole quantity of the liquid having overflowed the main tank cannot return to the main tank, and there always remains in the reservoir tank the part of the liquid that does not return to the main tank, resulting in a problem that the part of the liquid that remains in the reservoir tank cannot be used.

SUMMARY OF THE INVENTION

In view of the foregoing and other drawbacks, disadvantages and problems of the conventional methods and structures, a first object of the present invention is to provide a liquid container which can temporarily store liquid having overflowed as a result of a variation in air pressure and thereby prevent liquid leaks and, at the same time, allows the use of the whole quantity of the liquid that has temporarily stored.

In order to achieve the object stated above, a liquid container according to the invention comprises a body having a main tank in which liquid is stored, supply outlet positioned at the tip of the body for supplying the liquid, a guiding portion connecting the main tank and the supply outlet to guide the liquid from the main tank to the supply outlet, and a liquid reservoir having an air flow port communicating with the outside, a liquid flow port communicating with the main tank or the guiding portion, and a reservoir tank for storing the liquid overflowing the main tank. The reservoir tank stores the liquid on the side farther away from the supply outlet than the liquid flow port.

When the pressure in the main tank rises, the liquid having overflowed the main tank moves from the liquid flow port of the liquid reservoir to the reservoir tank and is stored therein. As this causes the liquid having overflowed the main tank to be shunted into the reservoir tank, the liquid is prevented from flowing out to the supply outlet, and its dropping from the supply outlet can be avoided.

When the pressure in the main tank returns to its previous level, the liquid having stored in the reservoir tank is caused by the pressure of the external atmosphere let in through the air flow port to return from the reservoir tank to the main tank via the liquid flow port. When the supply outlet is directed downward to use the liquid container, the liquid having stored in the reservoir tank is moved toward the liquid flow port by gravity and the pressure of the external atmosphere let in through the air flow port, and is supplied to the supply outlet via the guiding portion. As the reservoir tank stores the liquid on the side farther away from the supply outlet than the liquid flow port, the whole quantity of the liquid having stored in the reservoir tank is directed by gravity toward the liquid flow port. Thus it is made possible to fully use the liquid having stored in the reservoir tank.

The reservoir tank of the liquid reservoir can be arranged outside in the radial direction of the main tank, and this configuration makes it possible to store the liquid on the side farther away from the supply outlet than the liquid flow port.

Alternatively, the reservoir tank maybe arranged outside in the radial direction of the guiding portion, and the air flow port may be arranged on the side farther away from the supply outlet than the liquid flow port, and this configuration makes it possible to store the liquid on the side farther away from the supply outlet than the liquid flow port.

The liquid flow port of the liquid reservoir can be arranged on a side of the supply outlet before the connecting point between the main tank and the guiding portion, and this enables the air-tightness within the main tank to be secured by the liquid in the main tank. This configuration serves to prevent air from infiltrating into the main tank and the liquid from dropping from the supply outlet.

Preferably, the main tank should communicate with the external atmosphere only via the air flow port, the reservoir tank and the liquid flow port of the liquid reservoir. This configuration enables the liquid in the reservoir tank, pulled by gravity and placed under the pressure of the external atmosphere all the time, to be supplied to the supply outlet before that in the main tank is supplied to the supply outlet because, when there is liquid in the reservoir tank, the main tank is in a sealed state, isolated from the exterior.

It is preferable for this reservoir tank to be configured of a single passage extending from the liquid flow port to the air flow port. This configuration enables, in a state in which liquid is stored in the reservoir tank, the main tank to be securely kept in a sealed state. The passage can be provided in a shape of spiral or in a shape of proceeding in the axial direction while reciprocating in circumferential directions. It enables the reservoir tank to secure a sufficient capacity.

The liquid flow port can be arranged near the tip of the guiding portion. Further in the guiding portion, a liquid flow path, extending from the main tank to the liquid flow port, for letting a surplus quantity of liquid from the main tank flow can be formed.

Also, it is preferable for the air flowport to communicate with the exterior via an air passage and through an opening provided adjacent to the supply outlet. The air passage can be arranged further outside the reservoir tank in the radial direction.

Further, the body may have an outer cylinder and an inner cylinder concentrically arranged within the outer cylinder, and a groove formed on the outer circumferential face of the inner cylinder may constitute the reservoir tank. This makes it possible to store the liquid on the side farther away from the supply outlet than the liquid flow port. Preferably the body further has an intermediate cylinder concentrically arranged between the outer cylinder and the inner cylinder, and a gap formed between the outer circumferential face of the intermediate cylinder and the inner circumferential face of the outer cylinder constitutes an air passage connecting the air flow port and the exterior, thereby enabling an air passage to be secured. Alternatively, a groove formed on the outer circumferential face of the inner cylinder not crossing the groove to be constituted the reservoir tank may constitute an air passage connecting the air flow port and the exterior, and the air passage can be secured in this way. Further, the inner circumferential face of the outer cylinder and the groove on the inner cylinder can constitute the reservoir tank, and a linear groove formed on the outer circumferential face of the inner cylinder can constitute an air passage connecting the air flow port and the exterior.

Alternatively, the body can have an inner cylinder, an intermediate cylinder on the outer circumferential side of the inner cylinder and the outer cylinder on the outer circumferential side of the intermediate cylinder, the inner circumferential face of the intermediate cylinder and the outer circumferential face of the inner cylinder constitute the reservoir tank, and the gap formed between the outer circumferential face of the intermediate cylinder and the inner circumferential face of the outer cylinder constitute an air passage connecting the air flow port and the exterior. This configuration makes it possible to store the liquid on the side farther away from the supply outlet than the liquid flow port, to secure a sufficient capacity of the reservoir tank and to secure an air passage.

Also, at least part of the internal space of the inner cylinder or the internal space of the outer cylinder may constitute the main tank, or the main tank may be composed of a cartridge detachably connected to part of the body.

Further, components containing the inner cylinder and positioned within the outer cylinder may be inserted from the rear end of the outer cylinder and fitted therewithin.

It is also possible to provide a second reservoir tank facing the guiding portion. The second reservoir tank facing the guiding portion can prevent liquid from dropping from the supply outlet even more securely by storing liquid having overflowed the main tank. The second reservoir tank can be formed in a shape permitting accommodation of liquid or of a liquid holding member capable of absorbing liquid. Or the second reservoir tank may communicate with the external atmosphere by a second air passage.

The present disclosure relates to the subject matter contained in the Japanese Patent Applications Nos. 2002-337975 filed on Nov. 21, 2001 and 2003-365048 filed on Oct. 24, 2002, which are expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which:

FIG. 6A shows a view from the tip, and FIG. 6B, a section of an outer cap;

FIG. 7A shows a view from the tip, and FIG. 7B, a section of an inner cap;

DETAILED DESCRIPTION OF THE PREFERRED EMBODIMENTS

Preferred embodiments of the present invention will be described below with reference to the accompanying drawings.

(First Preferred Embodiment)

Figure 1:
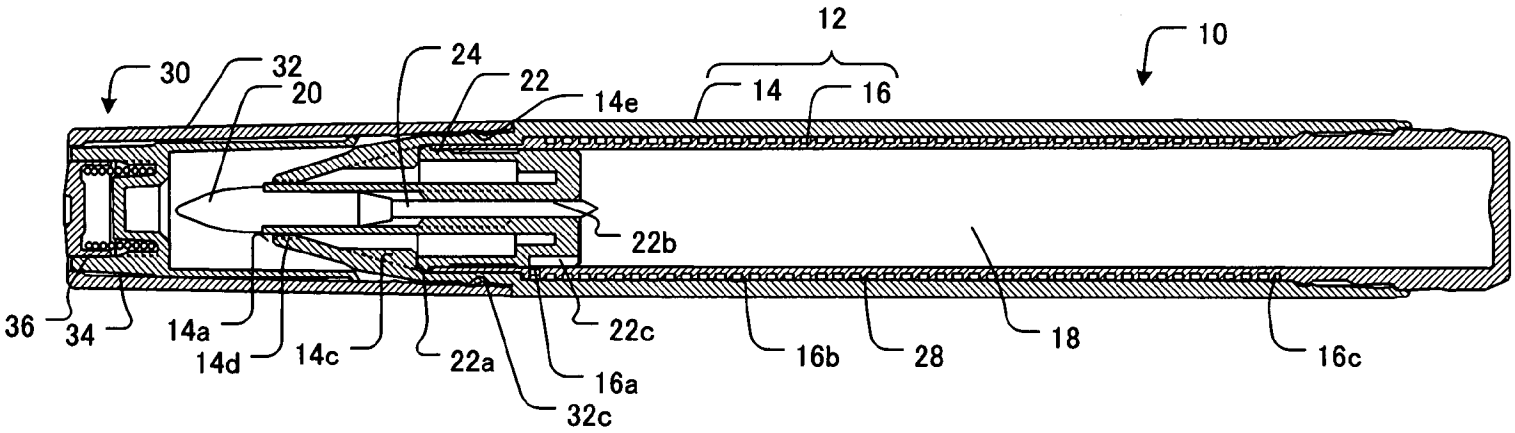
FIG. 1 shows a longitudinal section of a liquid container according to a first preferred embodiment of the invention.
Figure 2:
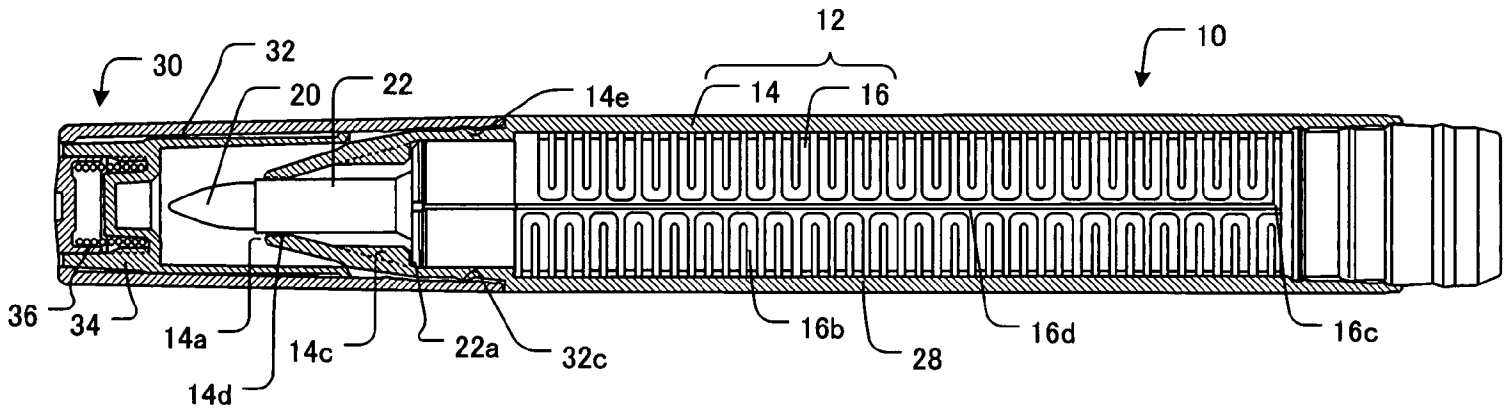
FIG. 2 shows a longitudinal partially sectional view of the first preferred embodiment.

FIG. 1 and FIG. 2 respectively show a longitudinal view with fully sectioned and partially sectioned of a liquid container, which is a first preferred embodiment of the present invention.

This liquid container 10 is provided with a body 12, and the body 12 comprises an outer cylinder 14 and an inner cylinder 16 concentrically inserted into the outer cylinder 14. Apart of an internal space of the inner cylinder 16 constitutes a main tank 18, and the main tank 18 accommodates liquid for writing, picture drawing, cosmetic or medicinal use.

From a tip opening 14*a* provided at the tip of the outer cylinder 14 projects a pen nib 20, which is the liquid supply outlet for supplying liquid to a prescribed position when the vessel is used. The pen nib to serve as the liquid supply outlet for the invention is not limited to one of the form illustrated therein, but can be any other desired pen nib, such as a fountain pen nib, a ballpoint pen point or a felt pen tip.

The base of the pen nib 20 is fixed to an inner plug 22, and the inner plug 22, with its front flange 22*a* being held between the inner stepped face of the outer cylinder 14 and the front end face of the inner cylinder 16, is fixed to the body 12. It is desirable for the outer diameter of the front flange 22*a* to be smaller than that of the front end face of the inner cylinder 16, so that this configuration secures passableness between an air passage 16*d*, to be described afterwards, of the inner cylinder 16 and a space ahead of the inner plug 22. A junction core 24 penetrates the center hole 22*b* of the inner plug 22, and the rear end of the junction core 24 projects into the main tank 18 while the front end of the junction core 24 is in contact with the pen nib 20. These center hole 22*b* of the inner plug 22 and junction core 24 constitute a guiding portion for guiding the liquid from the main tank 18 to the pen nib 20. Incidentally, it is also possible to compose the pen nib 20 and the junction core 24 as an integral component.

Figure 3B:
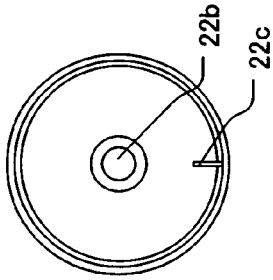
FIG. 3A shows the bottom and FIG. 3B, a rear view of an inner plug.
Figure 3A:
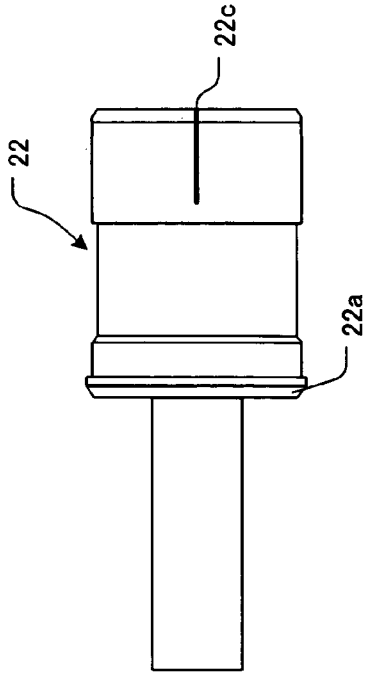
Figure 11:
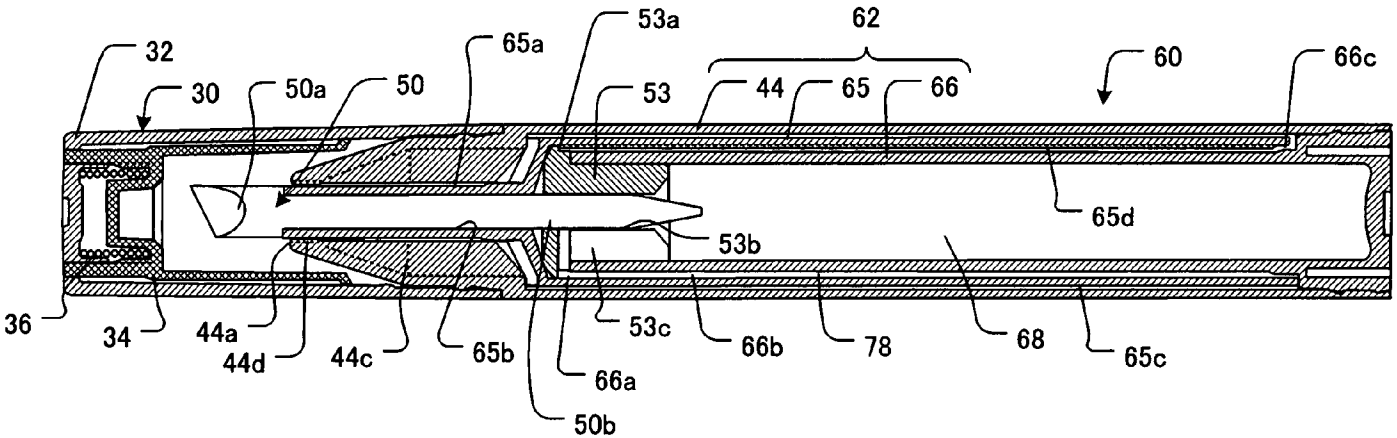
FIG. 11 shows a longitudinal section of a liquid container according to a third preferred embodiment of the invention.

At the rear end portion of the inner plug 22 is formed a slit 22*c*, which has some length from the rear end of the inner plug 22 toward its tip and a depth extending in the radial direction from the outer circumferential face not so far as to reach the center hole 22*b*. The sectional area of that slit 22*c* is adequate for allowing liquid to shift by capillarity and may be, for instance, approximately not less than 0.1 mm in depth and 0.01 mm to 0.5 mm in width, or the depth and the width being reversed (see FIGS. 3). The depth of the slit 22*c* can as well be sufficient to reach the center hole 22*b* as shown in FIG. 11, or a liquid flow port 16*a* described below may be connected to the junction core 24 via the slit 22*c*. In that case, the liquid flow port 16*a* and the junction core 24 should preferably be connected to each other where they face the main tank 18.

Figure 4B:
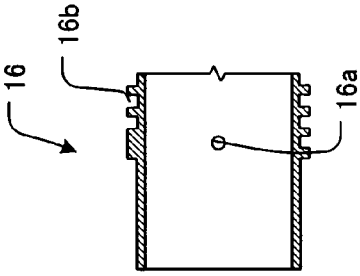
FIG. 4A shows the bottom and FIG. 4B, a section of a front portion of the inner cylinder.
Figure 4A:
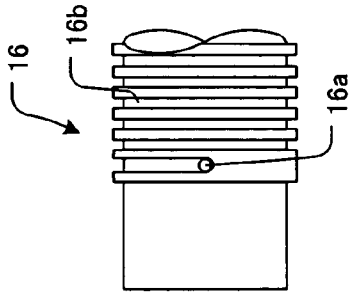

Communicating with the slit 22*c*, the liquid flow port 16*a* is bored in the circumferential face of the inner cylinder 16 (see FIGS. 4A & B). Continuing from this liquid flow port 16*a*, one overflowing liquid flow path 16*b* is formed on the outer circumferential face of the inner cylinder 16 on the rear side, reverse to the pen nib 20. This overflowing liquid flow path 16*b*, constituting a reservoir tank 28 together with the inner circumferential face of the outer cylinder 14, comprises grooves formed on the outer circumferential face of the inner cylinder 16. In order to secure a sufficient total length of the grooves, namely a sufficient capacity of the reservoir tank, the overflowing liquid flow path 16*b* is laid in a shape of progressing in the axial direction while extending back and forth in the circumferential direction of the outer circumferential face of the inner cylinder 16. The overflowing liquid flow path 16*b* may as well be laid spirally instead of being laid in the illustrated shape.

Figure 5:
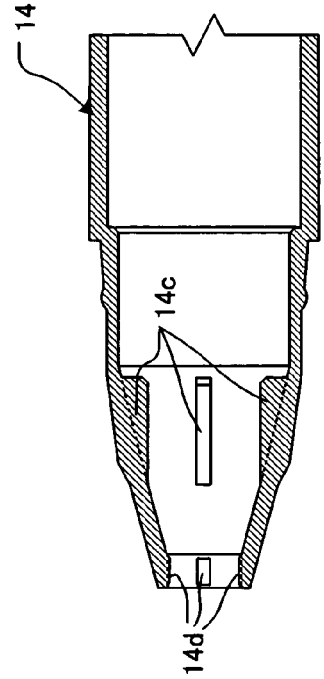
FIG. 5 shows a section of a front portion of an outer cylinder.

This reservoir tank 28 is arranged on an outer circumferential side of the main tank 18 being separated by the inner cylinder 16. The rear end of the overflowing liquid flow path 16*b* constitutes an air flow port 16*c*. Further, following the air flow port 16*c*, one linear air flow path 16*d* is formed on the outer circumferential face of the inner cylinder 16. This air flow path 16*d*, constituting an air passage together with the inner circumferential face of the outer cylinder 14, is formed on the part of the outer circumferential face of the inner cylinder 16 where the overflowing liquid flow path 16*b* is not formed, and is a fine groove linearly extending in the axial direction. This air flow path 16*d* communicates with voids formed between a plurality of ribs 14*c* formed on the inner circumferential face of the tip part of the outer cylinder 14 and with voids formed between a plurality of ribs 14*d* formed on the inner circumferential face of the very tip of the outer cylinder 14, and further communicates with the exterior through these voids and via the tip opening 14*a* (see FIG. 5). The liquid flowport 16*a*, reservoir tank 28 and airflow port 16*c* constitute a liquid reservoir. Incidentally, either of the ribs 14*c* and 14*d* can be omitted.

A cap 30 is detachably fitted to the tip of the outer cylinder 14. The cap 30 is provided with an outer cap 32 (see FIGS. 6A & B) and an inner cap 34 (see FIGS. 7A & B) concentrically and slidably inserted into the outer cap 32. A flange 34*a* is provided at the tip of the inner cap 34, and the flange 34*a* comes into contact with an annular convex 32*a* formed on the inner circumferential face of the outer cap 32 to prevent the inner cap 34 from coming off the outer cap 32. The annular convex 32*a* need not be formed all around but may be a partial rib. On the inner circumferential face of the outer cap 32 are formed ribs 32*c* that can be snapped onto the outer cylinder 14.

At the top of the outer cap 32 is formed arcuate air flow ports 32*b*, and at the top of the inner cap 34 is formed arcuate projections 34*b* that can be inserted into the arcuate air flow ports 32*b*. Between the top of the outer cap 32 and the top of the inner cap 34, a spring 36 is interposed, which forces the two tops to move away from each other.

When the cap 30 is fitted to the tip of the outer cylinder 14, a snap-on part 14*e* formed at the tip of the outer cylinder 14 is snapped onto the ribs 32*c* of the outer cap 32, and the outer cylinder 14, being in contact with the inner cap 34, presses the inner cap 34 out toward the top of the outer cap 32. This causes the inner cap 34 to shift toward the top of the outer cap 32 against the spring force of the spring 36, and the projections 34*b* of the inner cap 34 are inserted into the air flow ports 32*b* of the outer cap 32. Therefore, the cap 30 looks as if it had no hole and is not adversely affected in aesthetic appearance. On the other hand, when the cap 30 is removed from the outer cylinder 14, the spring force of the spring 36 causes the projection 34*b* of the inner cap 34 to come out of the air flow port 32*b* of the outer cap 32, and the air flow port 32*b* becomes able to let air flow through. This enables the air flow ports 32*b* to secure an air tract even if somebody swallows the cap 30 by mistake.

Next will be described the operations of the liquid container 10. In the liquid container 10 configured as described above, if the pressure within the main tank 18 rises to a higher level than the external atmospheric pressure, liquid having overflowed the main tank 18 will pass the slit 22*c* of the inner plug 22 to flow into the overflowing liquid flow path 16*b* from the liquid flow port 16*a*. As this causes the overflowing liquid to be shunted into the reservoir tank 28, no liquid will flow to the pen nib 20, thereby making it possible to prevent the liquid from dropping from the pen nib 20.

When the pressure in the main tank 18 or the external atmospheric pressure returns to the previous level, the liquid having stored in the reservoir tank 28 passes the liquid flow port 16*a* from the reservoir tank 28 and returns to the main tank 18 via the slit 22*c* of the inner plug 22.

When the pen nib 20 is turned downward to use the LIQUID CONTAINER 10, the liquid in the main tank 18 is fed to the pen nib 20 at the tip through the junction core 24 as liquid consumption by the pen nib 20 proceeds. Then, the atmospheric pressure is let into the main tank 18 through the air flow port 16*c*, and the liquid having stored in the reservoir tank 28 is directed toward the liquid flow port 16*a* and fed to the main tank 18 through the slit 22*c*. As a result, the whole quantity of liquid having overflowed into the reservoir tank 28 is consumed. The main tank 18 is so configured as to communicate with the exterior via the overflowing liquid flow path 16*b* constituting the reservoir tank 28 and via the air flow path 16*d*. As the reservoir tank 28 is configured of a single overflowing liquid flow path 16*b* and the main tank 18 is above the slit 22*c*, the interior of the main tank 18 is in a sealed state, isolated from the exterior. In order to use the liquid in the main tank 18 in this state, it is necessary to supply air into the main tank 18, and this results in simultaneous feeding of the liquid having stored in the overflowing liquid flow path 16*b*, namely the reservoir tank 28, into the main tank 18. In this way, the liquid having stored in the reservoir tank 28 wholly returns to the main tank 18 to be used for the intended purpose of the liquid container.

Figure 8:
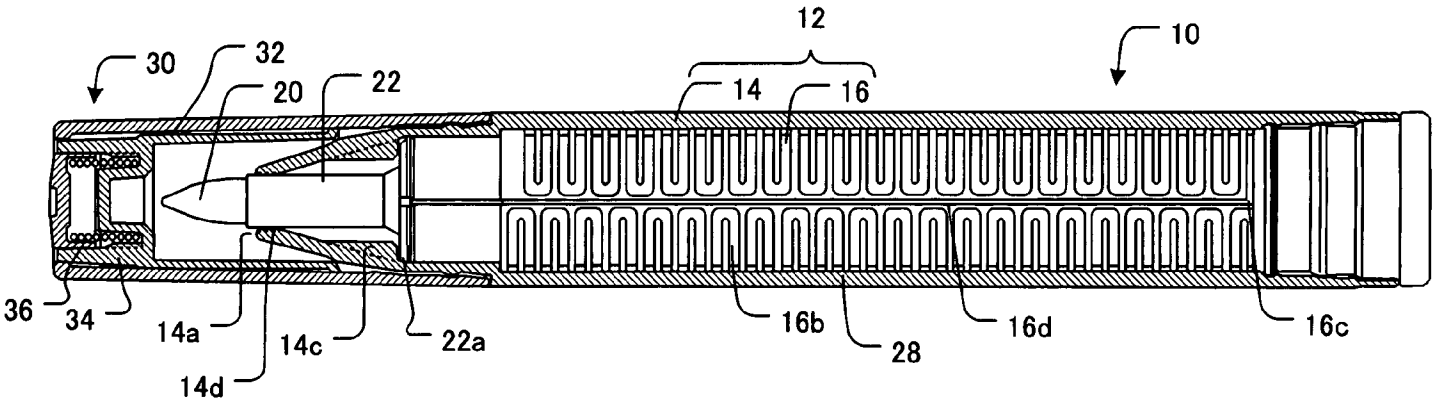
FIG. 8 shows a longitudinal partially sectional view of a modified version of the first preferred embodiment.

FIG. 8 shows a modified version of the first preferred embodiment of the invention. While a snap-on part, onto which the cap 30 removed from the tip of the outer cylinder 14 is to be snapped, is formed at the rear end of the body 12, namely the rear end of the inner cylinder 16, in the non-modified version, this modified version differs from the original in that it has no such snap-on part, but it is the same as the original in all other respects. Therefore, no further description of this version will be made.

Figure 20:
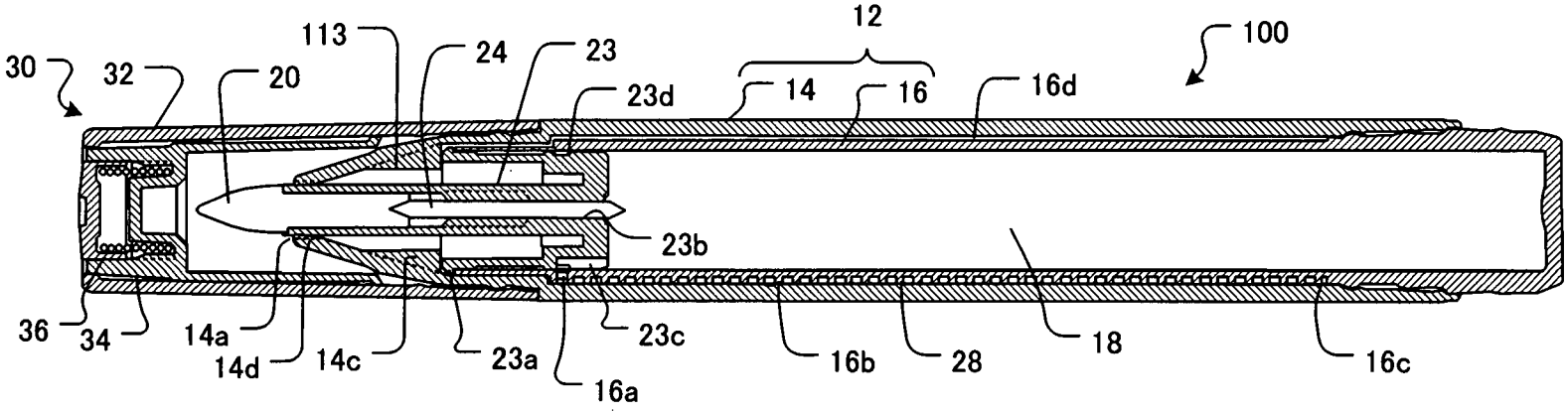
FIG. 20 shows a section of a modified version of the first preferred embodiment.
Figure 21:
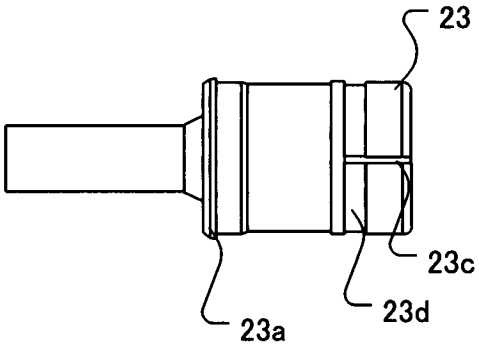
FIG. 21 shows the bottom of the inner plug of the modified version of the first preferred embodiment.

FIG. 20 shows another modified version of the first preferred embodiment. An inner plug 23 of this version, with its front flange 23*a* being held between the inner stepped face of the outer cylinder 14 and the front end face of the inner cylinder 16, is fixed to the body 12. The outer diameter of the front flange 23*a* is somewhat smaller than that of the inner cylinder 16, and this configuration serves to secure passableness between the air flowpath 16*d* of the inner cylinder 16 and the space ahead of the inner plug 23. The junction core 24 penetrates the central hole 23*b* of the inner plug 23, and the rear end of the junction core 24 protrudes into the main tank 18 while the tip of the junction core 24 is in contact with the pen nib 20. The central hole 23*b* of this inner plug 23 and the junction core 24 constitute a guiding portion for guiding the liquid from the main tank 18 to the pen nib 20.

At the rear end portion of the inner plug 23 is formed a slit 23*c*, which has some length from the rear end of the inner plug 23 toward its tip and a depth extending in the radial direction from the outer circumferential face not so far as to reach the center hole 23*b*. The sectional area of that slit 23*c* is adequate for allowing liquid to shift by capillarity and may be, for instance, approximately not less than 0.1 mm in depth and 0.01 mm to 0.5 mm in width, or the depth and the width being reversed. The depth of the slit 23*c* can as well be sufficient to reach the center hole 23*b* as shown in FIG. 11, or a liquid flow port 16*a* may be connected to the junction core 24 via the slit 23*c*. In that case, the liquid flow port 16*a* and the junction core 24 should preferably be connected to each other where they face the main tank 18.

Communicating with the slit 23*c* of the inner plug 23, an annular groove 23*d* is formed on the outer circumferential face of the inner plug 23, and this annular groove 23*d* communicates with the liquid flowport 16*a* of the inner cylinder 16. The presence of this annular groove 23*d* prevents the slit 23*c* of the inner plug 23 and the liquid flow port 16*a* of the inner cylinder 16 from communicating directly with each other, but allows them to communicate via the annular groove 23*d*. Therefore, there is no need for alignment between the slit 23*c* of the inner plug 23 and the liquid flow port 16*a* of the inner cylinder 16 in the circumferential direction. In other words, the inner plug 23 can be fitted to the body 12 without requiring any special positioning.

(Second Preferred Embodiment)

Figure 9:
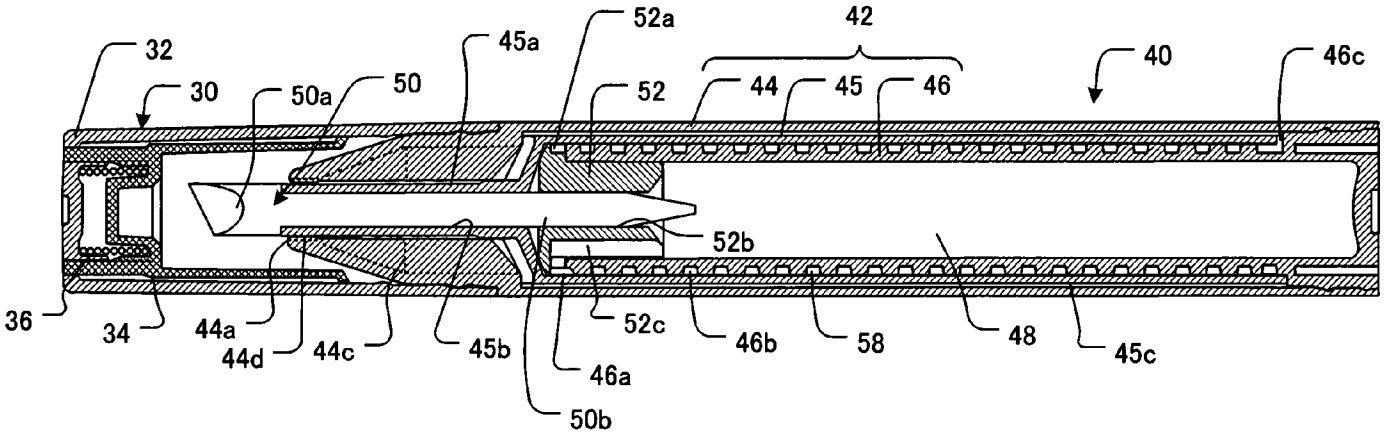
FIG. 9 shows a longitudinal section of a liquid container according to a second preferred embodiment of the invention.
Figure 10:
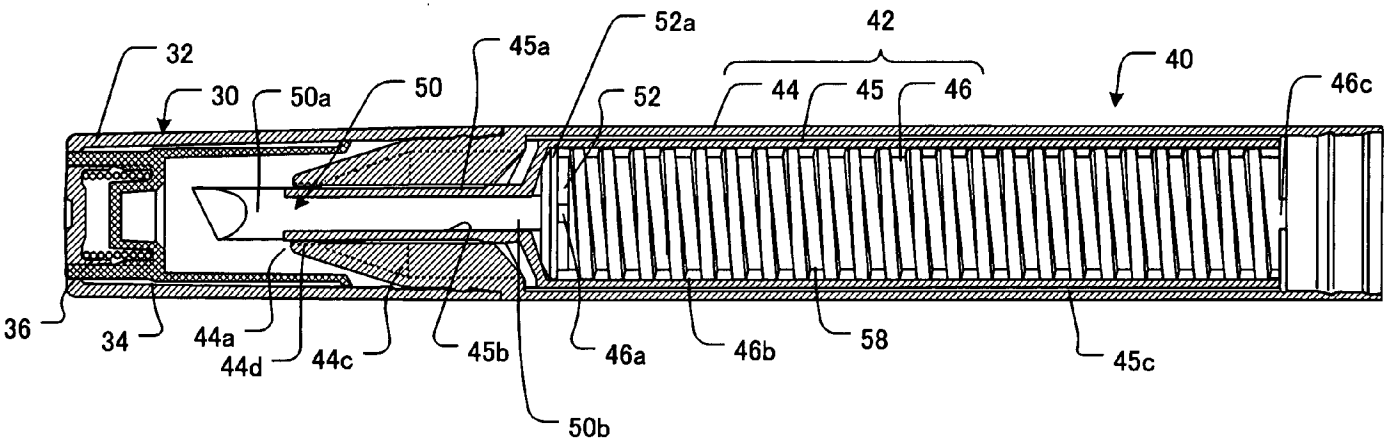
FIG. 10 shows a longitudinal partially sectional view of the second preferred embodiment.

FIG. 9 and FIG. 10 respectively show a longitudinal view with fully sectioned and partially sectioned of a liquid container, which is a second preferred embodiment of the invention.

This liquid container 40 is provided with a body 42, which comprises an outer cylinder 44, an intermediate cylinder 45 concentrically inserted into the outer cylinder 44, and an inner cylinder 46 concentrically inserted into the intermediate cylinder 45. The intermediate cylinder 45 has a reduced diameter portion 45*a* on its tip end side, the reduced diameter portion 45*a* being in pressed contact with ribs 44*c* and 44*d* within the tip part of the outer cylinder 44, and a gap is formed between the outer circumferential face of an expanded diameter portion 45*c* farther backward than the reduced diameter portion 45*a* of the intermediate cylinder 45 and the correspondingly facing inner circumferential face of the outer cylinder 44. The inner space of the inner cylinder 46 constitutes a main tank 48, and the main tank 48 accommodates liquid for writing, picture drawing, cosmetic or medicinal use.

From a tip opening 44*a* provided in the tip part of the outer cylinder 44 protrudes the tip 50*a* of a pen nib 50, which is the liquid supply outlet for supplying liquid to a prescribed position when the vessel is used.

The pen nib 50 has an extending portion 50*b* extending backward from the tip 50*a*, serving as the liquid supply outlet for supplying liquid to a prescribed position when the vessel is used, and the extending portion 50*b* penetrates the center hole 45*b* of the reduced diameter portion 45*a* extending toward the tip of the intermediate cylinder 45. Between the base of the reduced diameter portion 45*a* of the intermediate cylinder 45 and the tip face of the inner cylinder 46 is held a front flange 52*a* of an inner plug 52, which is fixed to the body 42. The extending portion 50*b* also penetrates a center hole 52*b* of the inner plug 52, and the rear end of the extending portion 50*b* protrudes into the main tank 48. The center hole 45*b* of the reduced diameter portion 45*a* of the intermediate cylinder 45, the center hole 52*b* of the inner plug 52 and the extending portion 50*b* of the pen nib 50 constitute a guiding portion for guiding the liquid from the main tank 48 to the tip 50*a* of the pen nib 50. Incidentally, although the tip 50*a* of the pen nib 50 and the extending portion 50*b* are integrally formed here, it is also possible to configure them as separate components.

At the rear end portion of the inner plug 52 is formed a slit 52*c*, which has some length from the rear end of the inner plug 52 toward its tip and a depth extending in the radial direction from the outer circumferential face not so far as to reach the center hole 52*b*. The sectional area of that slit 52*c* is adequate for allowing liquid to shift by capillarity and may be, for instance, approximately not less than 0.1 mm in depth and 0.01 mm to 0.5 mm in width, or the depth and the width being reversed. The depth of the slit 52*c* can as well be sufficient to reach the center hole 52*b* as shown in FIG. 11, or a liquid flow port 46*a* may be connected to the extending portion 50*b* via the slit 52*c*. In that case, the liquid flow port 46*a* and the extending portion 50*b* should preferably be connected to each other where they face the main tank 48.

The liquid flow port 46*a* is bored in the circumferential face of the inner cylinder 46 so as to communicate with the slit 52*c*. Continuing from this liquid flowport 46*a* is formed one overflowing liquid flow path 46*b* on the outer circumferential face of the inner cylinder 46 on the back, i.e. reverse side to the pen nib 20. This overflowing liquid flow path 46*b*, constituting a reservoir tank 58 together with the inner circumferential face of the intermediate cylinder 45, is a groove formed on the outer circumferential face of the inner cylinder 46. In order to secure a sufficient total length of the groove, namely a sufficient capacity of the reservoir tank 58, the overflowing liquid flow path 46*b* is laid in a spiral shape. The groove can as well be laid in any other desired shape than the illustrated spiral shape.

This reservoir tank 58 is arranged on an outer circumferential side of the main tank 48 being separated by the inner cylinder 46. The rear end of the overflowing liquid flow path 46*b* constitutes an air flow port 46*c*. The air flow port 46*c* is formed between a stepped face formed in the rear part of the inner cylinder 46 and the rear end face of the intermediate cylinder 45, communicates with a gap formed between the outer circumferential face of the intermediate cylinder 45 and the inner circumferential face of the outer cylinder 44, and further communicates with a void formed between a plurality of ribs 44*c* formed on the inner circumferential face of the tip part of the outer cylinder 44 and between the inner circumferential face of the tip part of the outer cylinder 44 and the reduced diameter portion 45*a* of the intermediate cylinder 45 and with another void formed between a plurality of ribs 44*d* and between the inner circumferential face of the tip part of the outer cylinder 44 and the reduced diameter portion 45*a* of the intermediate cylinder 45, resulting in communication with the exterior via this void, through the tip opening 44*a*. The liquid flow port 46*a*, the reservoir tank 58 and the air flow port 46*c* constitute the liquid reservoir.

The liquid container 40 configured as described above according to the second preferred embodiment of the invention, provides the same effects and advantages as the liquid container 10 according to the first preferred embodiment. In this second preferred embodiment, the main tank 48 communicates with the external atmosphere through the gap between the inner circumferential face of the outer cylinder 44 and the outer circumferential face of the intermediate cylinder 45, and via the air flow port 46*c*, the overflowing liquid flow path 46*b*, the liquid flowport 46*a* and the slit 52*c*. In this embodiment, also, when the pressure in the main tank 48 rises, the liquid having overflowed the main tank 48 is shunted into the reservoir tank 58 and, when the liquid container is to be used, the liquid in the reservoir tank 58 returns to the main tank 48 and can be used in its full quantity.

(Third Preferred Embodiment)

Figure 12:
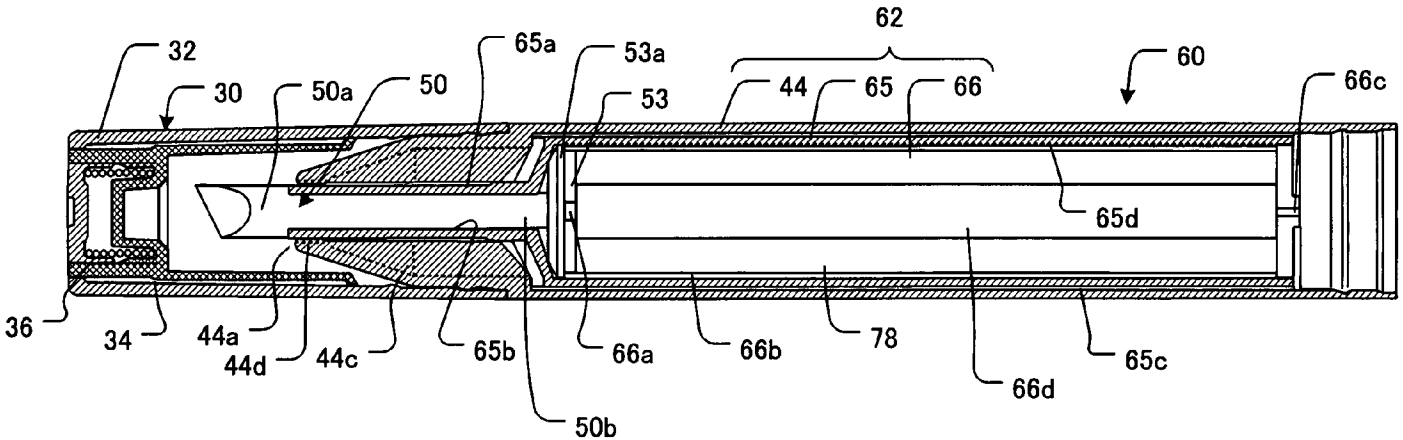
FIG. 12 shows a longitudinal partially sectional view in which only a part of the third preferred embodiment.

Now, FIG. 11 and FIG. 12 respectively show a longitudinal view with fully sectioned and partially sectioned of a liquid container, which is a third preferred embodiment of the present invention. In these drawings, the same constituent members as in the foregoing preferred embodiments will be denoted by respectively the same reference signs, and their detailed description will be dispensed with.

This liquid container 60 is provided with a body 62, which comprises the outer cylinder 44, an intermediate cylinder 65 concentrically inserted into the outer cylinder 44, and an inner cylinder 66 concentrically inserted into the intermediate cylinder 65.

The intermediate cylinder 65 has a reduced diameter portion 65*a* on its tip end side, the reduced diameter portion 65*a* being in pressed contact with the ribs 44*c* and 44*d* within the tip part of the outer cylinder 44, and a gap is formed between the outer circumferential face of an expanded diameter portion 65*c* farther backward than the reduced diameter portion 65*a* of the intermediate cylinder 65 and the correspondingly facing inner circumferential face of the outer cylinder 44. The inner space of the inner cylinder 66 constitutes a main tank 68, and the main tank 68 accommodates liquid for writing, picture drawing, cosmetic or medicinal use.

Between the base of the reduced diameter portion 65*a* of the intermediate cylinder 65 and the tip face of the inner cylinder 66 is held a front flange 53*a* of an inner plug 53, which is fixed to the body 62. The extending portion 50*b* also penetrates a center hole 53*b* of the inner plug 53, and the rear end of the extending portion 50*b* protrudes into the main tank 68. The center hole 65*b* of the reduced diameter portion 65*a* of the intermediate cylinder 65, the center hole 53*b* of the inner plug 53 and the extending portion 50*b* of the pen nib 50 constitute a guiding portion for guiding the liquid from the main tank 68 to the tip 50*a* of the pen nib 50. At the rear end portion of the inner plug 53 is formed a slit 53*c*, which has some length from the rear end of the inner plug 53 toward its tip and a depth reaching the center hole 53*b*. The depth may as well be smaller than that and not reach the center hole 53*b*. The sectional area of that slit 53*c* is adequate for allowing liquid to shift by capillarity and may be, for instance, approximately not less than 0.1 mm in depth and 0.01 mm to 0.5 mm in width, or the depth and the width being reversed.

A liquid flow port 66*a* is bored in the circumferential face of the inner cylinder 66 so as to communicate with the slit 53*c* of the inner plug 53. Continuing from this liquid flowport 66*a* is formed a gap between the outer circumferential face of the inner cylinder 66 and the inner circumferential face of the intermediate cylinder 65, and this gap constitutes a reservoir tank 78. Between the outer circumferential face of the inner cylinder 66 and the inner circumferential face of the intermediate cylinder 65 should preferably be formed ribs 66*d* and 65*d* as appropriate to prevent liquid from sticking to the wall within the reservoir tank 78. As many ribs as desired can be arranged.

At the read end of the reservoir tank 78 is formed an air flow port 66*c*. The air flow port 66*c* should preferably be about 0.01 mm to 0.5 mm either in height or in width or in both. The air flow port 66*c* is formed between a stepped face formed in the rear part of the inner cylinder 66 and the rear end face of the intermediate cylinder 65, communicates with a gap formed between the outer circumferential face of the intermediate cylinder 65 and the inner circumferential face of the outer cylinder 44, further communicates with a void formed between the plurality of ribs 44*c* formed on the inner circumferential face of the tip part of the outer cylinder 44 and between the inner circumferential face of the tip part of the outer cylinder 44 and the reduced diameter portion 65*a* of the intermediate cylinder 65 and with another void formed between the plurality of ribs 44*d* and between the inner circumferential face of the tip part of the outer cylinder 44 and the reduced diameter portion 65*a* of the intermediate cylinder 65, resulting in communication with the exterior via this void, through the tip opening 44*a*. The liquid flow port 66*a*, the reservoir tank 78 and the air flowport 66*c* constitute the liquid reservoir.

The liquid container 60 configured as described above according to the third preferred embodiment of the invention, provides the same effects and advantages as the liquid containers 10 and 40 according to the earlier described preferred embodiments.

(Fourth Preferred Embodiment)

Figure 13:
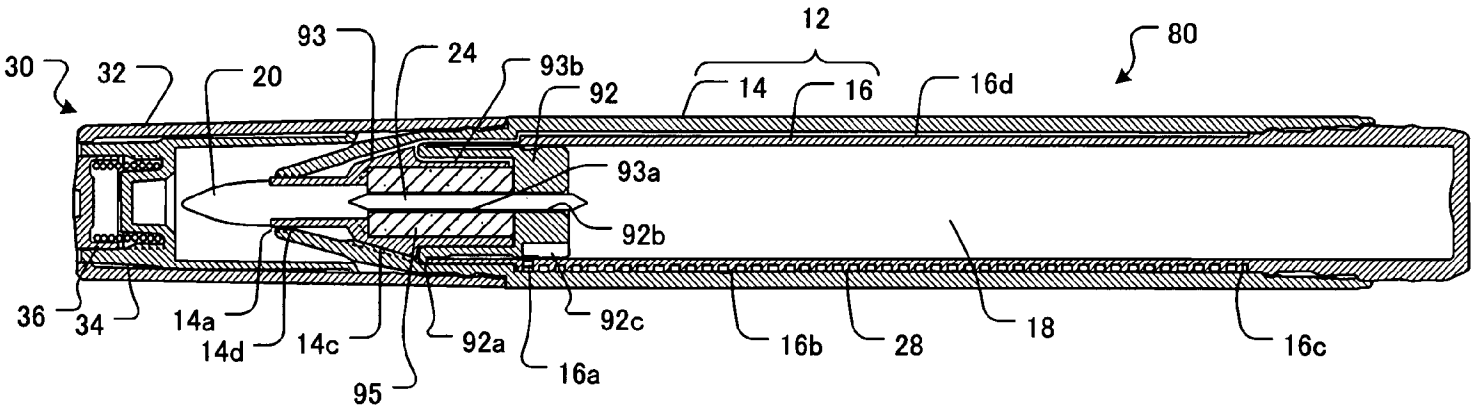
FIG. 13 shows a longitudinal section of a liquid container according to a fourth preferred embodiment of the invention.

Now, FIG. 13 shows a longitudinal section of a liquid container according to a fourth preferred embodiment of the invention. In this drawing, the same constituent members as in the foregoing preferred embodiments will be denoted by respectively the same reference signs, and their detailed description will be dispensed with.

This liquid container 80 is provided with the body 12, which comprises the outer cylinder 14, and an inner cylinder 16 concentrically inserted into the outer cylinder 14. A part of the inner space of the inner cylinder 16 constitutes the main tank 18, and the main tank 18 accommodates liquid for writing, picture drawing, cosmetic or medicinal use.

The base of the pen nib 20 is fixed to an inner plug 92, and the inner plug 92, with its front flange 92*a* being held between the inner stepped face of the outer cylinder 14 and the front end face of the inner cylinder 16, is fixed to the body 12. It is desirable for the outer diameter of the front flange 92*a* to be smaller than that of the front end face of the inner cylinder 16, so that this configuration secures passableness between the air passage 16*d* of the inner cylinder 16 and a space ahead of the inner plug 92. While the inner plug is a single component in the first preferred embodiment, in this embodiment there are the inner plug 92 and a nib base 93, the rear end of the latter being inserted into the tip part of the inner plug 92. A center hole 92*b* of the inner plug 92 and a center hole 93*a* of the nib base 93 are aligned linearly, and the junction core 24 penetrates the center hole 92*b* and the center hole 93*a* aligned on a straight line. These center hole 92*b* of the inner plug 92, center hole 93*a* of the nib base 93 and junction core 24 constitute a guiding portion for guiding the liquid from the main tank 18 to the pen nib 20.

Figure 15B:
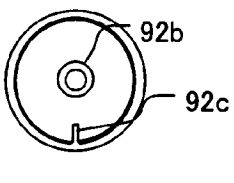
FIG. 15A shows the bottom and FIG. 15B, a rear view of an inner plug.
Figure 15A:
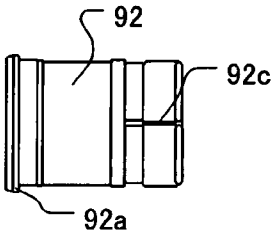

At the rear end portion of the inner plug 92 is formed a slit 92*c* (see FIGS. 15), which has some length from the rear end of the inner plug 92 toward its tip and a depth extending in the radial direction from the outer circumferential face not so far as to reach the center hole 92*b*. The sectional area of that slit 92*c* is adequate for allowing liquid to shift by capillarity and may be, for instance, approximately not less than 0.1 mm in depth and 0.01 mm to 0.5 mm in width, or the depth and the width being reversed. The depth of the slit 92*c* can as well be sufficient to reach the center hole 92*b* as shown in FIG. 11, or the liquid flowport 16*a* may be connected to the junction core 24 via the slit 92*c*. In that case, the liquid flowport 16*a* and the junction core 24 should preferably be connected to each other where they face the main tank 18.

Inside the nib base 93 is provided a liquid holding member 95 consisting of a material capable of absorbing liquid, such as padding or sponge. This liquid holding member 95, facing the guiding portion, is in contact with the outer circumference of the junction core 24, and serves as a second reservoir tank for storing the liquid overflowing the junction core 24, apart from the reservoir tank 28.

Figure 14B:
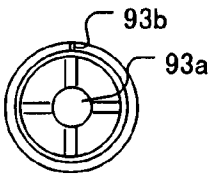
FIG. 14A shows a plan, and FIG. 14B, a rear view of a nib base.
Figure 14A:
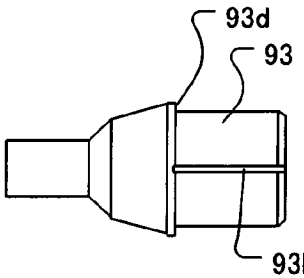

A fine groove is formed on the outer surface of the nib base 93, and this groove constitutes an air passage 93*b* (see FIG. 14). This groove can be about 0.01 mm to 0.5 mm either in width or in height or in both. This air passage 93*b* passes a gap between the rear end face of the nib base 93 and the inner plug 92 and communicates with the liquid holding member 95. The air passage 93*b* passes a gap between a stepped face 93*d* of the nib base 93 and the front end face of the inner plug 92, and further through a gap between the outer circumferential face of the nib base 93 and the inner circumferential face of the outer cylinder 14, and further through the void formed between the plurality of ribs 14*c* formed on the inner circumferential face of the tip part of the outer cylinder 14, another void formed between the plurality of ribs 14*d* and the tip opening 14*a*, communicates with the exterior. As in the first preferred embodiment, the air flow path 16*d* also communicates with the void formed between the plurality of ribs 14*c* formed on the inner circumferential face of the tip part of the outer cylinder 14 and with the other void formed between the plurality of ribs 14*d* formed on the inner circumferential face of the very tip of the outer cylinder 14, and communicates with the exterior via these voids, and the tip opening 14*a*.

In this preferred embodiment, as in the first preferred embodiment, when the pressure in the main tank 18 rises, the liquid having overflowed the main tank 18 is shifted from the liquid flow port 16*a* to the overflowing liquid flow path 16*b* passing the slit 92*c* of the inner plug 92, and shunted into the reservoir tank 28; at the same time, in the guiding portion as well, the liquid holding member 95 absorbs the liquid to prevent from dropping from the pen nib 20 even more securely.

(Fifth Preferred Embodiment)

Figure 16:
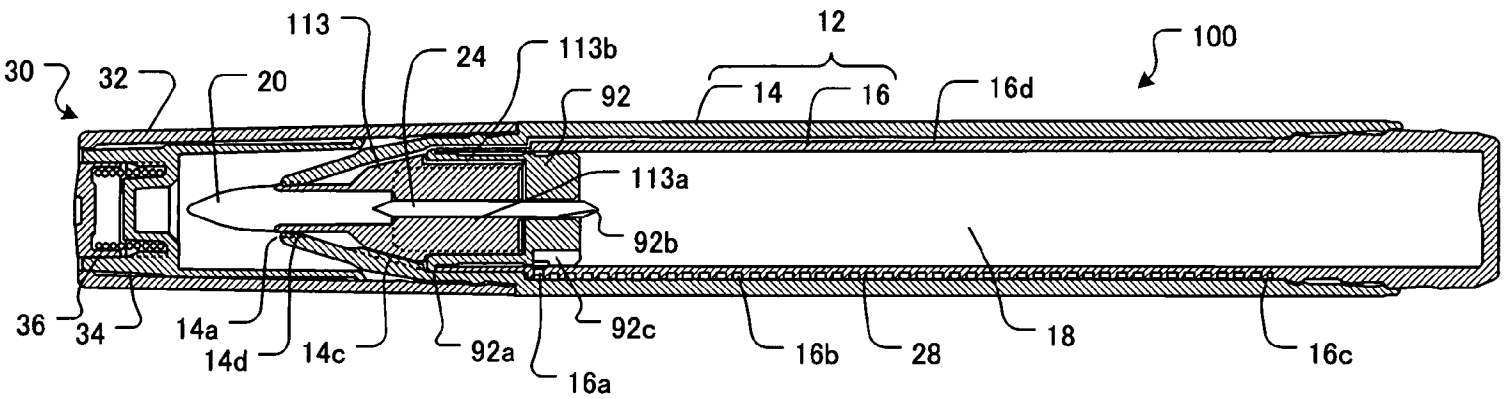
FIG. 16 shows a longitudinal section of a liquid container according to a fifth preferred embodiment of the invention.

Now, FIG. 16 shows a longitudinal section of a fifth preferred embodiment of the present invention. In this drawing, the same constituent members as in the foregoing preferred embodiments will be denoted by respectively the same reference signs, and their detailed description will be dispensed with.

A liquid container 100 of this preferred embodiment, is provided with a nib base 113 in place of the nib base 93 in the fourth preferred embodiment, and the rear end of the nib base 113 is inserted into the tip of the inner plug 92. The center hole 92*b* of the inner plug 92 and a center hole 113*a* of the nib base 113 are aligned linearly, and the junction core 24 penetrates the center hole 92*b* and the center hole 113*a* aligned on a straight line. These center hole 92*b* of the inner plug 92, center hole 113*a* of the nib base 113 and junction core 24 constitute a guiding portion for guiding the liquid from the main tank 18 to the pen nib 20.

Figure 17B:
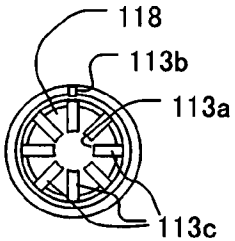
FIG. 17A shows a plan, FIG. 17B, a rear view and FIG. 17C, a section of the inner plug in the fifth preferred embodiment.
Figure 17A:
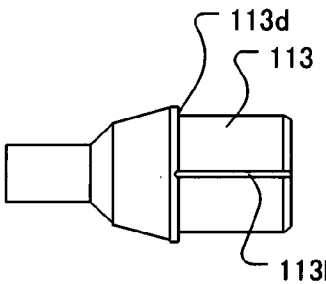
Figure 17C:
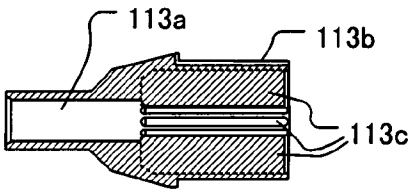

A plurality of radially extending ribs 113*c* are formed within the nib base 113, and a space between adjoining ribs 113*c* constitutes a second reservoir tank 118 for storing liquid (see FIGS. 17).

A fine groove is formed on the outer surface of the nib base 113, and this groove constitutes an air passage 113*b* (see FIG. 17). This groove can be about 0.01 mm to 0.5 mm either in width or in height or in both. This air passage 113*b* passes a gap between the rear end face of the nib base 113 and the inner plug 92 and communicates with the second reservoir tank 118. The air passage 113*b* passes the gap between the stepped face 113*d* of the nib base 113 and the front end face of the inner plug 92, and further through the gap between the outer circumferential face of the nib base 113 and the inner circumferential face of the outer cylinder 14, and further through the void formed between the plurality of ribs 14*c* formed on the inner circumferential face of the tip part of the outer cylinder 14, the other void formed between the plurality of ribs 14*d* and the tip opening 14*a*, communicates with the exterior.

In this preferred embodiment, as in the fourth preferred embodiment, when the pressure in the main tank 18 rises, the liquid having overflowed the main tank 18 is shifted from the liquid flow port 16*a* to the overflowing liquid flow path 16*b* past the slit 92*c* of the inner plug 92, and shunted into the reservoir tank 28; at the same time, in the guiding portion as well, the second reservoir tank 118 can store the liquid to enable dropping from the pen nib 20 to be prevented even more securely.

Figure 18:
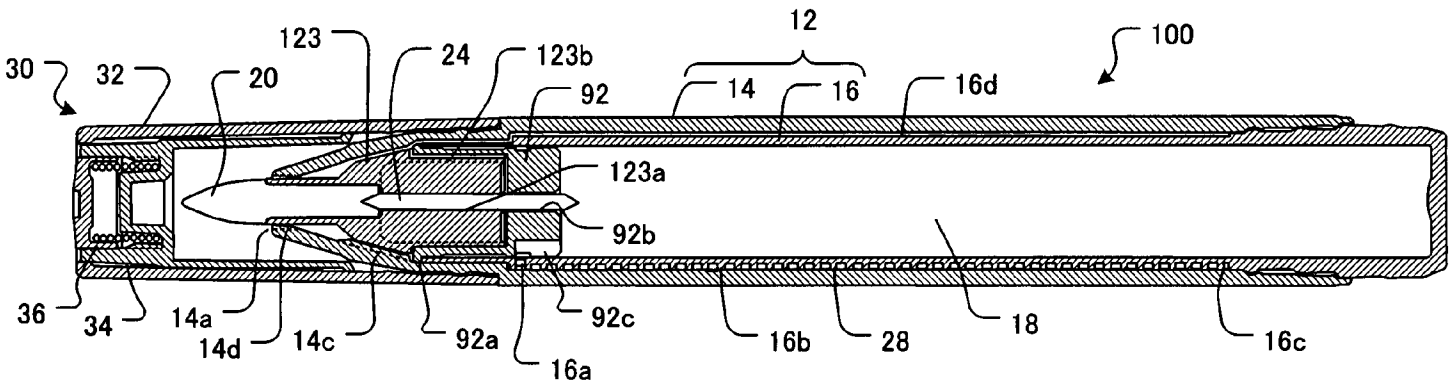
FIG. 18 shows a modified version of the liquid container of the fifth preferred embodiment of the invention.
Figure 19B:
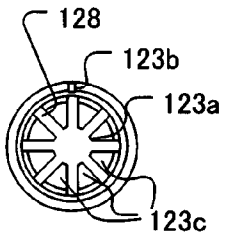
FIG. 19A shows a plan, FIG. 19B, a rear view, and, FIG. 19C, a section of the inner plug of a modified version of the fifth preferred embodiment.
Figure 19A:
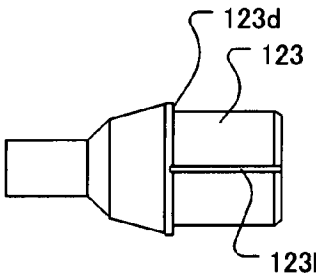
Figure 19C:
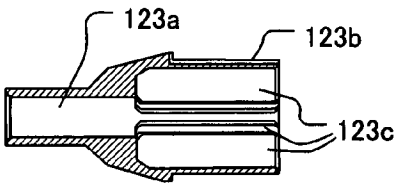

FIG. 18 shows a modified version of the liquid container of the fifth preferred embodiment of the invention. In this drawing, the same constituent members as in the foregoing preferred embodiments will be denoted by respectively the same reference signs, and their detailed description will be dispensed with.

In this embodiment, only the shape of ribs 123*c* of a nib base 123 differs from the nib base 113 of the original fifth preferred embodiment, but in all other respects the nib base 113 of the fifth preferred embodiment is the same as the nib base 123. While the section of the ribs 113*c* in the fifth preferred embodiment is fragmentally shaped and that of the second reservoir tank 118 formed by adjoining ribs 113*c* is sector-shaped, the ribs 123*c* of this modifier version have a sector-shaped section, resulting in a fragmentally shaped section of a second reservoir tank formed by spaces between the adjoining ribs 123*c*. This version, in which the second reservoir tank 128 operates similarly to the second reservoir tank 118, provides the same effects and advantages as the original fifth preferred embodiment.

(Sixth Preferred Embodiment)

Figure 22:
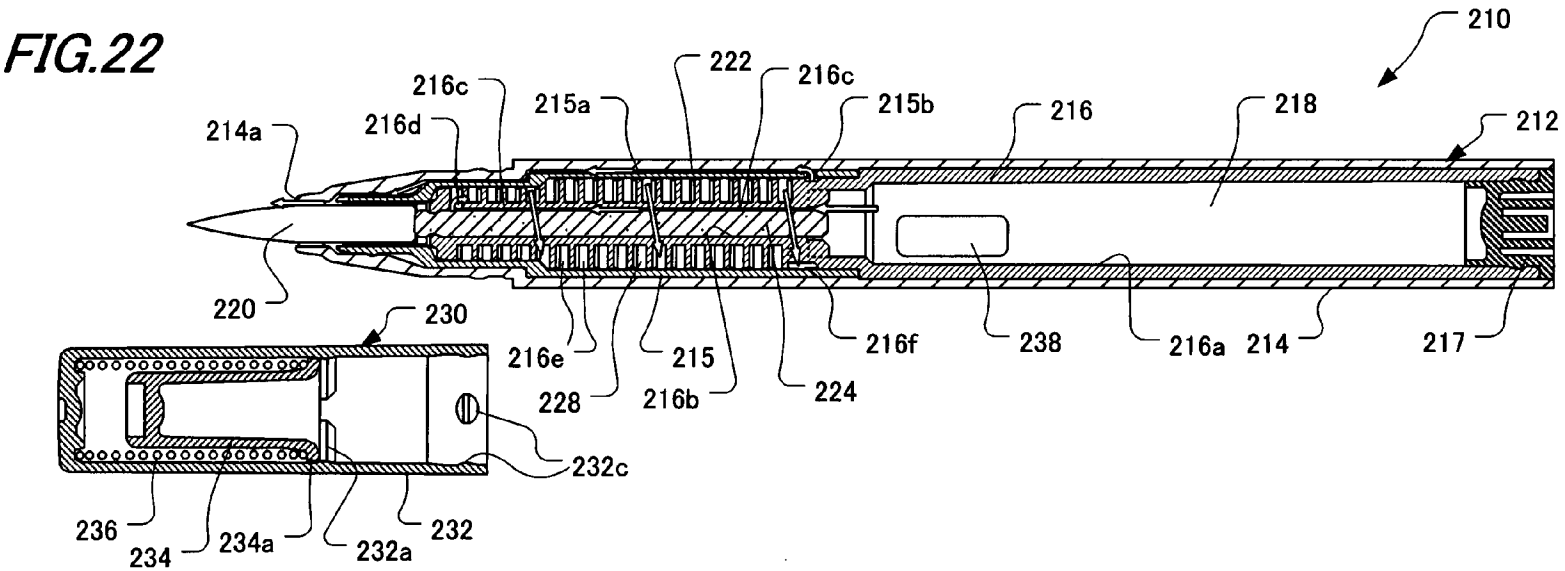
FIG. 22 shows a longitudinal section of a liquid container according to a sixth preferred embodiment of the invention in a state of being removed a cap.
Figure 23:
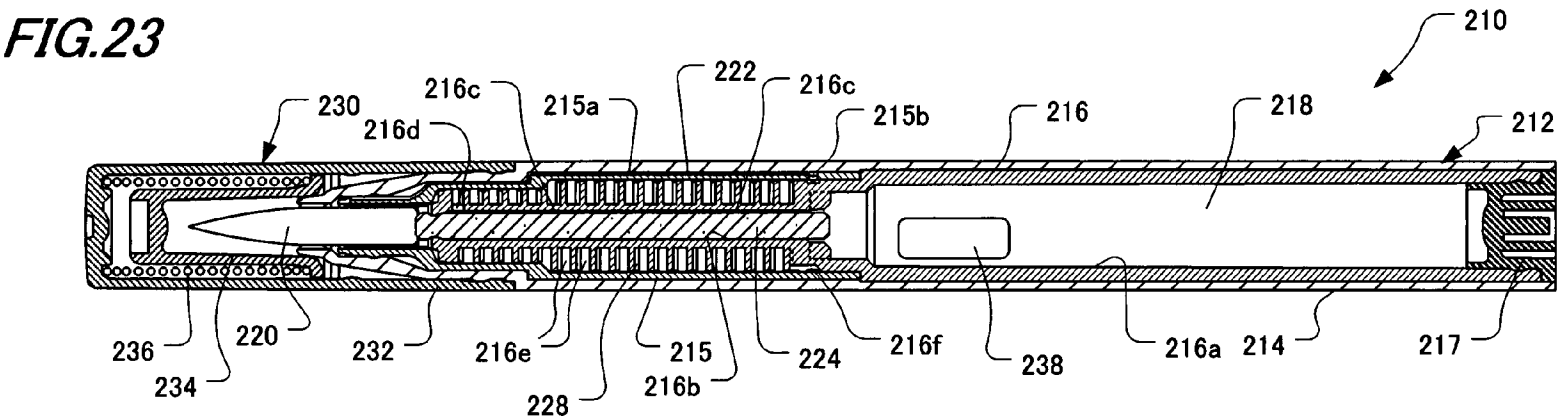
FIG. 23 shows a longitudinal section of the liquid container according to the sixth preferred embodiment, in a state of being fitted with a cap.

FIG. 22 shows a longitudinal section of a liquid container according to a sixth preferred embodiment of the invention. This liquid container 210 is provided with a body 212, which comprises an outer cylinder 214, an intermediate cylinder 215, an inner cylinder 216 and a tail plug 217. The intermediate cylinder 215 and the inner cylinder 216, together with a junction core 224 and a pen nib 220 described afterwards, are all inserted concentrically into an outer cylinder 214 from its rear end and fitted, and the rear end of the outer cylinder 214 is closed by the tail plug 217. A part of the internal space of the rear part of the inner cylinder 216 constitutes a main tank 218, and the main tank 218 accommodates liquid for writing, picture drawing, cosmetic or medicinal use.

From a tip opening 214*a* provided in the tip part of the outer cylinder 214 protrudes a pen nib 220, which is the liquid supply outlet for supplying liquid to a prescribed position when the vessel is used. The pen nib to serve as the liquid supply outlet for the invention is not limited to one of the form illustrated therein, but can be any other desired pen nib, such as a fountain pen nib, a ballpoint pen point or a felt pen tip.

Figures 24A, 24B, 24C:
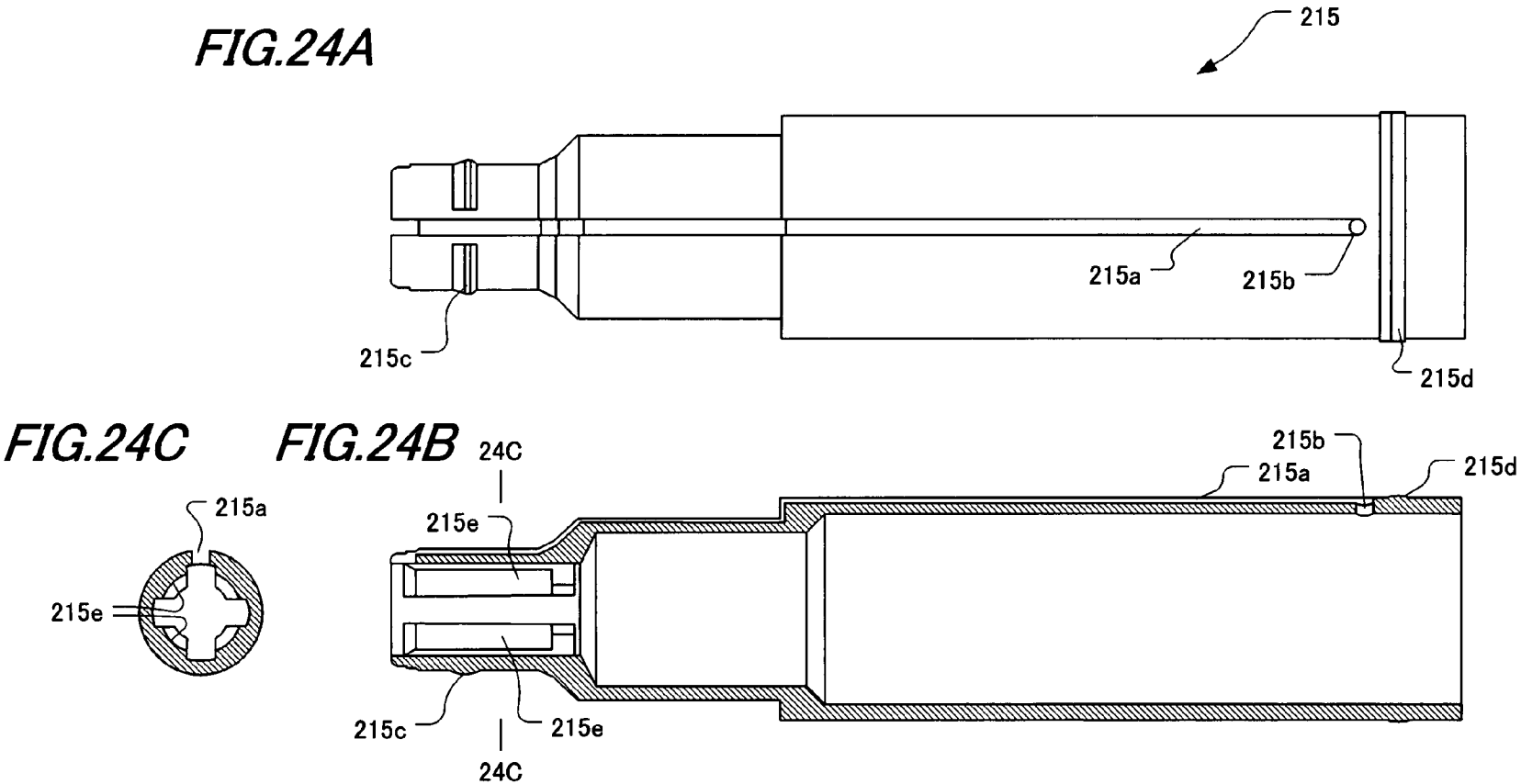
FIG. 24A shows a plan, FIG. 24B, a longitudinal section, and FIG. 24C, an end view along line 24C—24C in FIG. 24B of an intermediate cylinder of the liquid container.

The base of the pen nib 220 is fixed to the intermediate cylinder 215, which is, held and fixed between the internal stepped face of the outer cylinder 214 and the external stepped face of the central part of the inner cylinder 216 within the outer cylinder 214. As shown in FIGS. 24, on the outer face of the intermediate cylinder 215 is formed one air groove 215*a* extending in the axial direction, and the air groove 215*a* extends to the vicinity of the tip opening 214*a* of the outer cylinder 214. An air passage 222 is defined between the air groove 215*a* and the inner circumferential face of the outer cylinder 214. An air flow port 215*b* is formed at the rear end of the air groove 215*a*, and penetrates the circumferential wall of the intermediate cylinder 215. Furthermore, the intermediate cylinder 215 are formed ribs 215*c* and 215*d* on the front and the rear thereof, each extending in the circumferential direction and expanding in the direction of the outer diameter. The rib 215*c* is for fixing the intermediate cylinder 215 within the outer cylinder 214, while the rib 215*d* extends annularly to fix the intermediate cylinder 215 within the outer cylinder 214 and secure air-tightness between the intermediate cylinder 215, and the outer cylinder 214. A rib 215*e* is formed within the inner circumferential face of the tip of the intermediate cylinder 215, and expands in the direction of the inner diameter to fix the pen nib 220, and the rear end part of the rib 215*e* further step-likely projects in the direction of the inner diameter, to prevent the pen nib 220 from sinking into the body 212.

As stated above, a part of an internal space 216*a* in the rear part of the inner cylinder 216 and the tail stopper 217 constitute the main tank 218, and a center hole 216*b* of the front part of the inner cylinder 216 communicating with the internal space 216*a*, together with the junction core 224, constitute a guiding portion. Thus, as the junction core 224 penetrates the center hole 216*b*, and the rear end of the junction core 224 protrudes into the main tank 218 and the tip of the junction core 224 is in contact with the pen nib 220, the center hole 216*b* of the inner cylinder 216 and the junction core 224 constitute the guiding portion for guiding the liquid from the main tank 218 to the pen nib 220. Incidentally, it is also possible to configure the pen nib 220 and the junction core 224 as an integrated component. In the center hole 216*b* is formed a single liquid flow groove (liquid flow path) 216*c* extending in the axial direction.

Figure 25A:
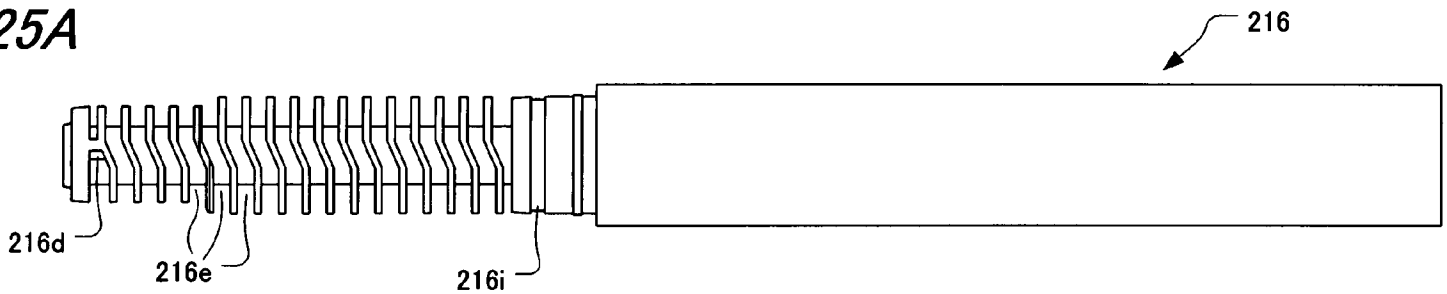
FIG. 25A shows a plan, FIG. 25B, a longitudinal section of FIG. 25A and FIG. 25C, the bottom of the inner cylinder.
Figure 25B:
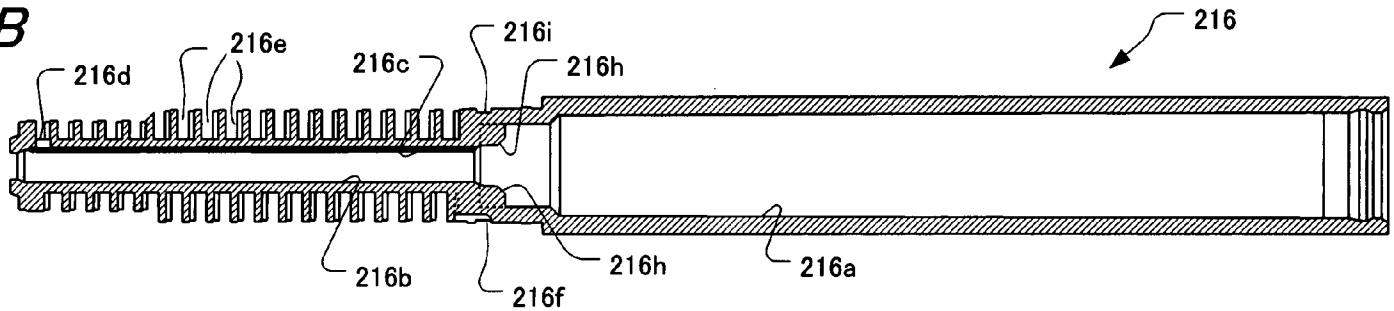
Figure 25C:
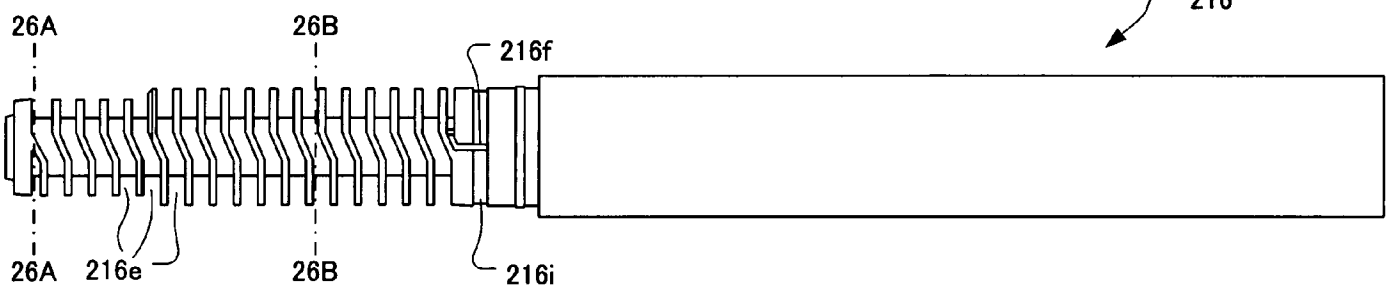

In the inner cylinder 216, as shown in FIGS. 25, there is formed a liquid flow port 216*d* penetrating the circumferential wall of the cylinder in its fore part, and this liquid flow port 216*d* communicates with the liquid flow groove 216*c*. Further, communicating with this liquid flow port 216*d*, a groove 216*e* spirally extends on the outer circumferential face of the fore part of the inner cylinder 216, and the groove 216*e*, together with the inner circumferential face of the intermediate cylinder 215, constitutes a spiral reservoir tank 228. The spirally extending groove 216*e* extends backwards, and a liquid and air groove (or air flow port) 216*f*, formed at the rear end of the groove 216*e*, is connected to an annular groove 216*i*, which communicates with the air flow port 215*b* of the intermediate cylinder 215. Thus, the reservoir tank 228 is configured of a single spiral passage, and this configuration serves to secure a sufficient capacity and prevents the liquid from becoming mixed with air. The reservoir tank 228 is isolated from the guiding portion by the front circumferential wall of the inner cylinder 216, and communicates only by way of the liquid flow port 216*d*. Relative positioning of the inner cylinder 216 and the intermediate cylinder 215 in the circumferential direction can be dispensed with, and the assembling facilitated, by connecting the liquid and air groove (or air flow port) 216*f* and the air flow port 215*b* by way of the annular groove 216*i*.

Furthermore, a plurality of ribs 216*h* protruding toward the junction core 224 are formed in the boundary part between the internal space 216*a* of the inner cylinder 216 and the center hole 216*b* to protect the rear end part of the junction core 224, however these ribs 216*h* can be omitted.

These liquid flow port 216*d*, reservoir tank 228 and air flow port 215*b* constitute the liquid reservoir.

A cap 230 is detachably fitted to the tip of the outer cylinder 214. The cap 230 is provided with an outer cap 232, an inner cap 234 concentrically and slidably inserted into the outer cap 232 and made slidable, and a spring 236 interposed between the inside of the top of the outer cap 232 and the top of the inner cap 234 to press them in the direction of forcing them away from each other. At the tip of the inner cap 234 is provided a flange 234*a*, which is in contact with an annular convex 232*a* formed on the inner circumferential face of the outer cap 232 to prevent the inner cap 234 from coming off the outer cap 232. The annular convex 232*a* may either be provided all around the circumference or may consist of ribs formed in the circumferential direction separated from each other. On the inner circumferential face of the outer cap 232 are formed ribs 232*c* that can be snapped onto the outer cylinder 214. When the cap 230 is fitted to the tip of the outer cylinder 214, the ribs 232*c* of the outer cap 232 snap onto the outer cylinder 214, and the inner cap 234 is in close contact with the vicinity of the outer cylinder 214 to secure air-tightness.

Within the main tank 218, a stirring bar 238 is movably disposed if the main tank 218 is filled with a liquid which needs stirring.

Next will be described the operations of the liquid container 210. In the liquid container 210 configured as described above, when the pressure in the main tank 218 rises relative to the external atmospheric pressure, the liquid having overflowed the main tank 218 passes the liquid flow groove 216*c* of the inner cylinder 216, and shifts from the liquid flow port 216*d* to the reservoir tank 228. In the reservoir tank 228, as the liquid flow port 216*d* is located in the front and the air flow port 215*b* is located in the back, the overflowing liquid flows from front to back (upward from below). The reservoir tank 228 is a single passage consisting of the groove 216*e*, and the liquid flows along that passage. The air which has been present in the reservoir tank 228 passes the liquid and air groove (or air flow port) 216*f* and the air flow port 215*b*, then passes the air passage 222, and further passes a gap (opening) formed between the inner circumferential face of the tip part of the outer cylinder 214 and the pen nib 220 to be discharged outside. Arrows in FIG. 22 represent these flows of liquid and air.

Since the overflowing liquid is shunted into the reservoir tank 228 as described above, no quantity of this liquid flows to the pen nib 220, and dropping from the pen nib 220 can be thereby prevented.

When the pressure in the main tank 218 or the external atmospheric pressure returns to its previous level, at least part of the liquid having stored in the reservoir tank 228 passes the liquid flow port 216*d* from the reservoir tank 228, and further passes the liquid flow groove 216*c* of the inner cylinder 216 to return to the main tank 218.

Next, when the pen nib 220 is turned downward to use the liquid container 210, the liquid in the main tank 218 is fed to the pen nib 220 at the tip through the junction core 224 as liquid consumption by the pen nib 220 proceeds. When any quantity of liquid is stored in the liquid reservoir, i.e. the reservoir tank 228, the liquid having stored in the reservoir tank 228, partly under the additional influence of gravity, is directed toward the liquid flow port 216*d*, and passes the liquid flow groove 216*c* to be fed either into the main tank 218 or to the pen nib 220 from the junction core 224.

Eventually, the full quantity of liquid having overflowed the reservoir tank 228 is consumed. The configuration is such that the main tank 218 communicates with the exterior via the liquid flow groove 216*c* and the liquid reservoir, and the reservoir tank 228 is configured of a single passage. In this state, in order to feed air into the main tank 218 to use the liquid in the main tank 218, the liquid having stored in the reservoir tank 228 has to return to the liquid flow port 216*d*. In this way, the full quantity of the liquid having stored in the reservoir tank 228 returns to the main tank 218 to become available for use.

The invention further has the following characteristics.

Figure 26A:
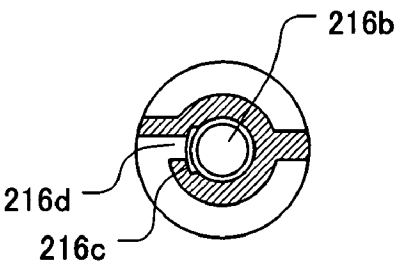
FIG. 26A shows an end view including the intermediate cylinder and a junction core along line 26A—26A, FIG. 26B, a similar end view along line 26B—26B, and FIG. 26C, a similar end view along line 26B—26B in FIG. 25C.
Figure 26B:
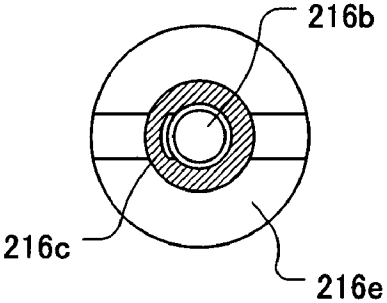
Figure 26C:
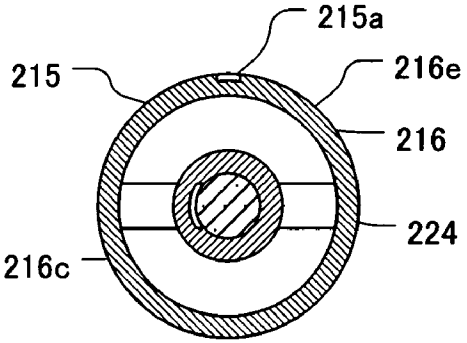
Figure 27A:
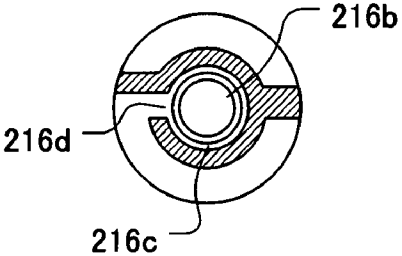
FIG. 27A through FIG. 27C, show another example of liquid flow groove, which are respective equivalents of FIG. 26A through FIG. 26C.
Figure 27B:
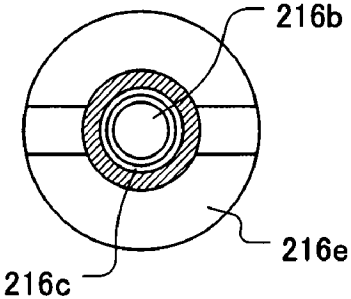
Figure 27C:
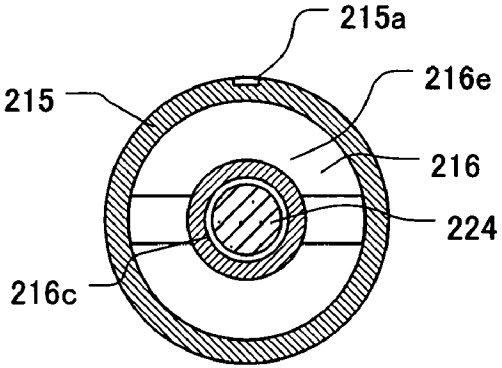
Figure 28C:
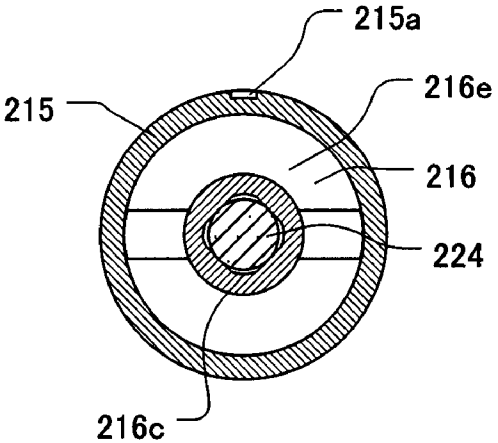
FIG. 28A through FIG. 28C, show yet another example of liquid flow groove, which are respective equivalents of FIG. 26A through FIG. 26C.
Figure 28B:
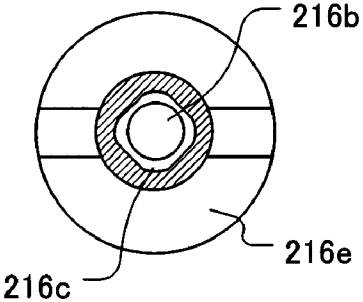
Figure 28A:
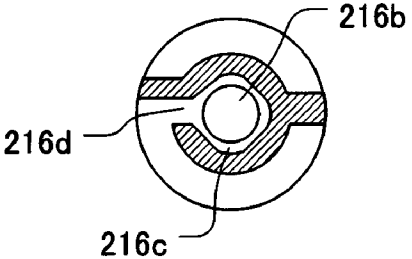
Figure 29C:
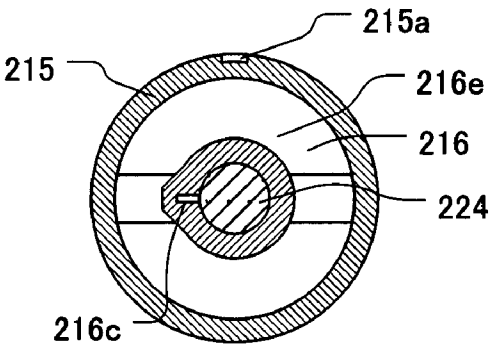
FIG. 29A through FIG. 29C, show still another example of liquid flow groove, which are respective equivalents of FIG. 26A through FIG. 26C.
Figure 29B:
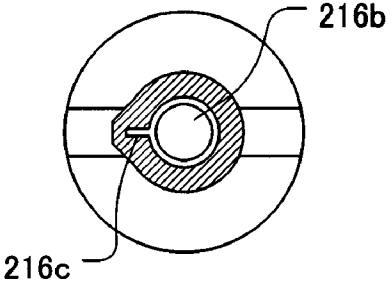
Figure 29A:
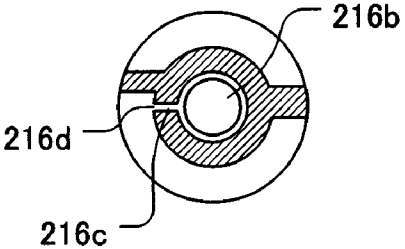

As the liquid flow groove 216*c* is adjacent to the peripheral surface of the junction core 224 and this liquid flow groove 216*c* is connected to the liquid flow port 216*d*, the overflowing liquid can flow from the main tank 218 to the reservoir tank 228 even under low pressure. Various modified shapes of this liquid flow groove 216*c* are conceivable in addition to what is shown in FIGS. 26. Some examples of modification are shown in FIGS. 27 through FIG. 29. While the example shown in FIGS.

26 has a wide groove in one circumferential part of the center hole 216*b* into which the junction core 224 is to be inserted and this groove constitutes the liquid flow groove 216*c*, in the example of FIG. 27 a groove is formed all around the center hole 216*b* into which the junction core 224 is to be inserted and this groove constitutes the liquid flow groove 216*c*. In the example of FIGS. 28, the sectional shape of the center hole 216*b* into which the junction core 224 is to be inserted is not round but rectangular, and gaps that are formed when the junction core 224 having the circular section is inserted into the center hole 216*b* constitute the liquid flow groove 216*c*. In the example of FIGS. 29, a deep groove is formed in one circumferential part of the center hole 216*b* into which the junction core 224 is to be inserted and this groove constitutes the liquid flow groove 216*c*. These examples are not the only available alternatives, but the liquid flow groove 216*c* can have any desired configuration. Such a liquid flow groove 216*c* enables the liquid having overflowed the main tank 218 to readily flow along the liquid flow groove 216*c* to shift to the liquid reservoir.

While the usual configuration of the reservoir tank of a conventional liquid reservoir is a pleated mechanism in a comb-like shape to utilize capillarity, the conventional pleated mechanism requires enhanced capillarity to increase the force to hold the liquid, and this is achieved by narrowing the spacing between the comb teeth especially in the part closer to the main tank and widening it toward the front, which requires precision machining with a tolerance of 0.15 mm to 1 mm. Unlike that, the reservoir tank 228 according to the invention requires no such construction, the spacing between adjacent grooves 216*e* can be around 1 mm, which means remarkable molding ease and can ensure improved moldability.

When this liquid container 210 is held upright for use, the gravity of the liquid in the main tank 218 is transmitted from the junction core 224 to the pen nib 220, the gravity of the liquid contained in the junction core 224 wholly acts on the pen nib 220. As a result, if the volume of the liquid of the main tank is the same, a shorter junction core 224 would be more advantageous because it helps reduce the quantity of liquid applying on the pen nib 220. As the reservoir tank 228 according to the invention does not use capillarity, the width of the groove 216*e* can be increased, and the volume of the spatial part of the reservoir tank 228 can be increased, the overall length of the reservoir tank 228 can be made shorter than a conventional reservoir tank having the same capacity, and the length from the main tank 218 to the pen nib 220, i.e. the length of the junction core 224 can be reduced compared with the conventional configuration.

While the function of the conventional pleated mechanism is maintained by increasing its wettability by treating the pleats themselves with acid, the reservoir tank 228 according to the invention is intended for storing, rather than holding, liquid and accordingly requires no acid treatment.

As the conventional pleated mechanism is molded with a split pattern, the split line of the die remains on the surface of the mechanism. Furthermore, whereas a fine groove for liquid is formed at the rear end to let in liquid from the main tank, during assembly, application of high pressure in fitting could cause clogging of that fine groove, making its adjustment extremely difficult, the reservoir tank 228 without such a fine groove for liquid readily permits pressly fitting into the outer cylinder. Furthermore, where the inner cylinder 216, which is an integral unit, defines the main tank 218 and also forms the groove 216*e* constituting the reservoir tank 228 as in this preferred embodiment, the sealing of the main tank 218 can be kept tight enough.

Figure 30A:
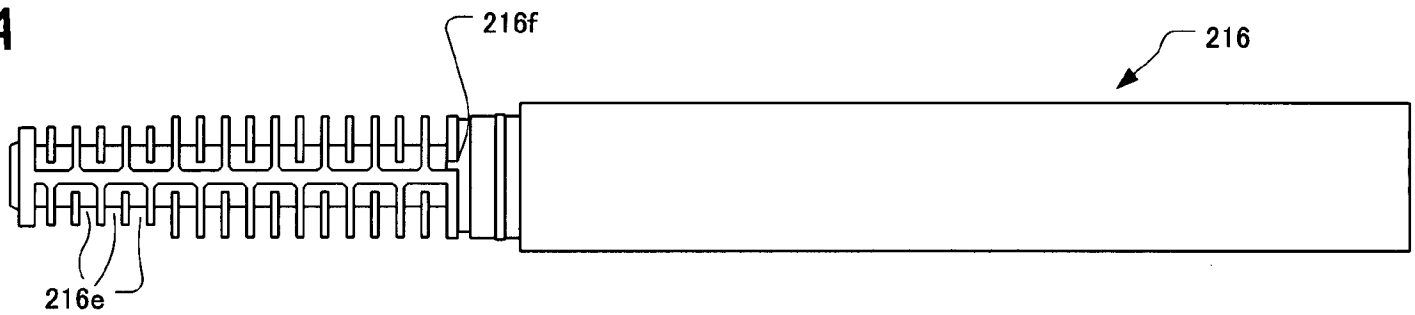
FIG. 30A through FIG. 30C, show another example of inner cylinder constituting another reservoir tank, which are respective equivalents of FIG. 25A through FIG. 25C.
Figure 30B:
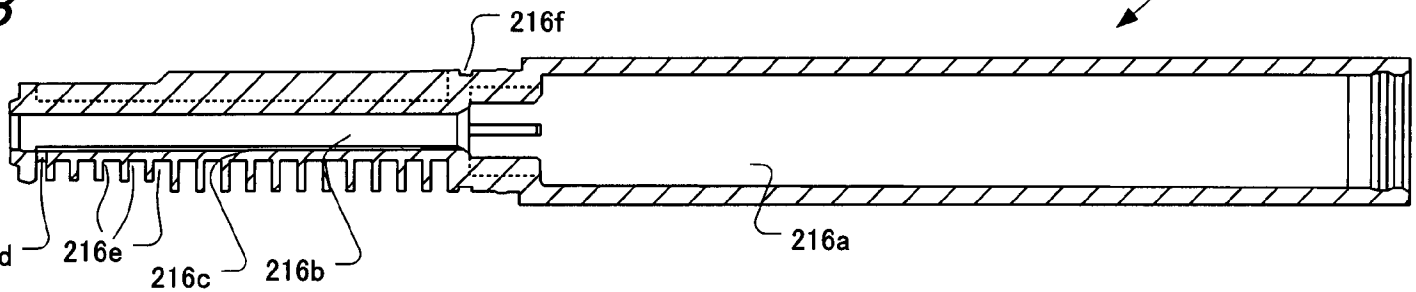
Figure 30C:
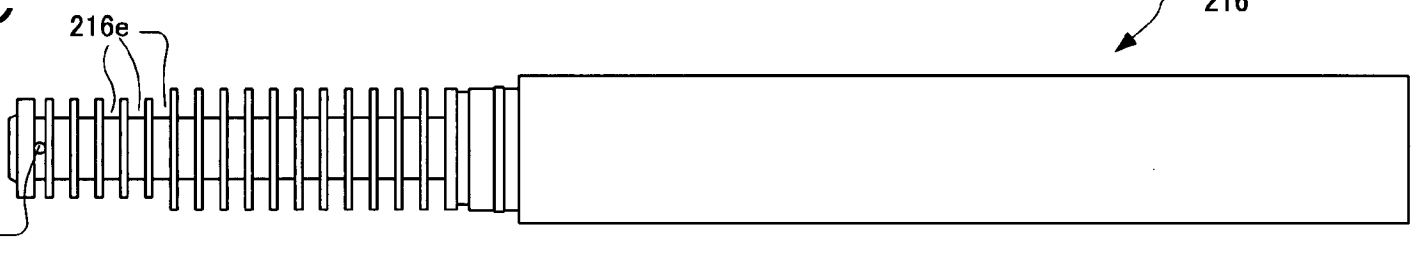
Figure 31A:
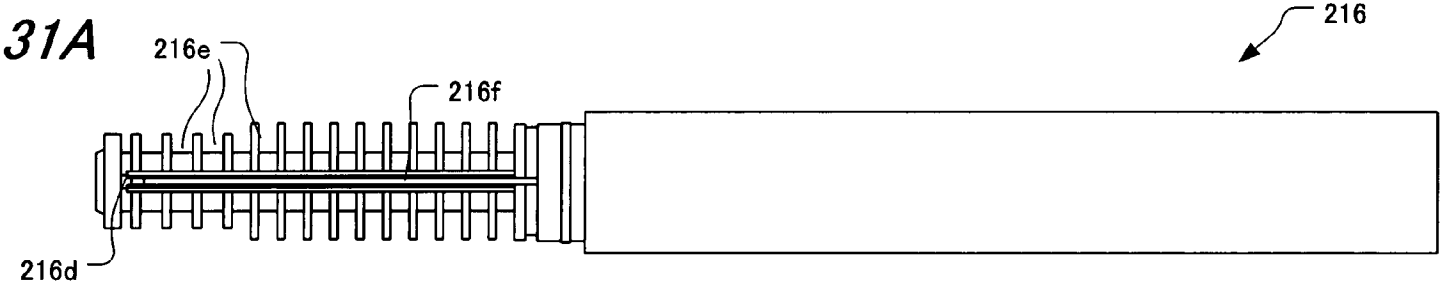
FIG. 31A through FIG. 31C, show yet another example of inner cylinder constituting reservoir tank, which are respective equivalents of FIG. 25A through FIG. 25C.
Figure 31B:
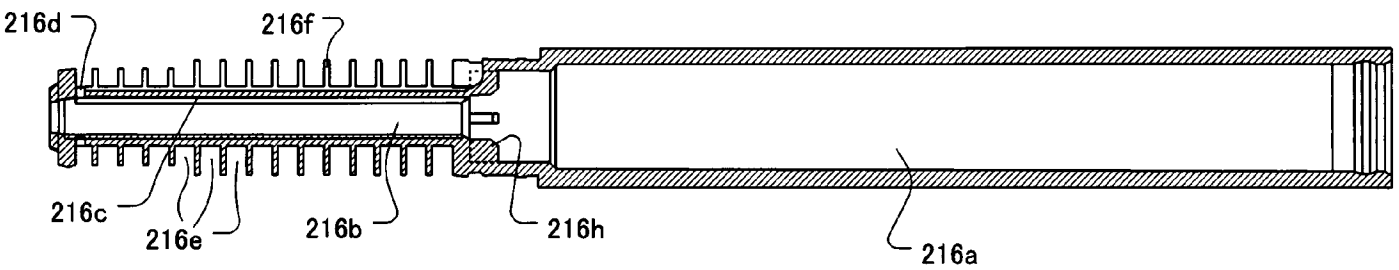
Figure 31C:
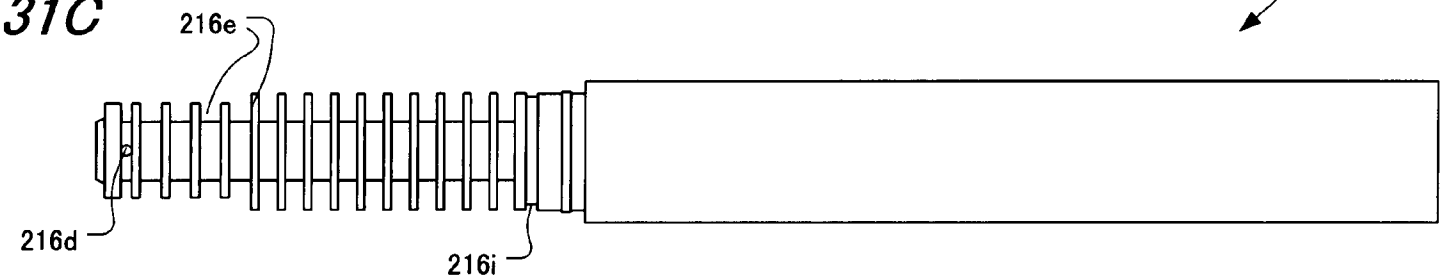
Figures 32A, 32B, 32C:
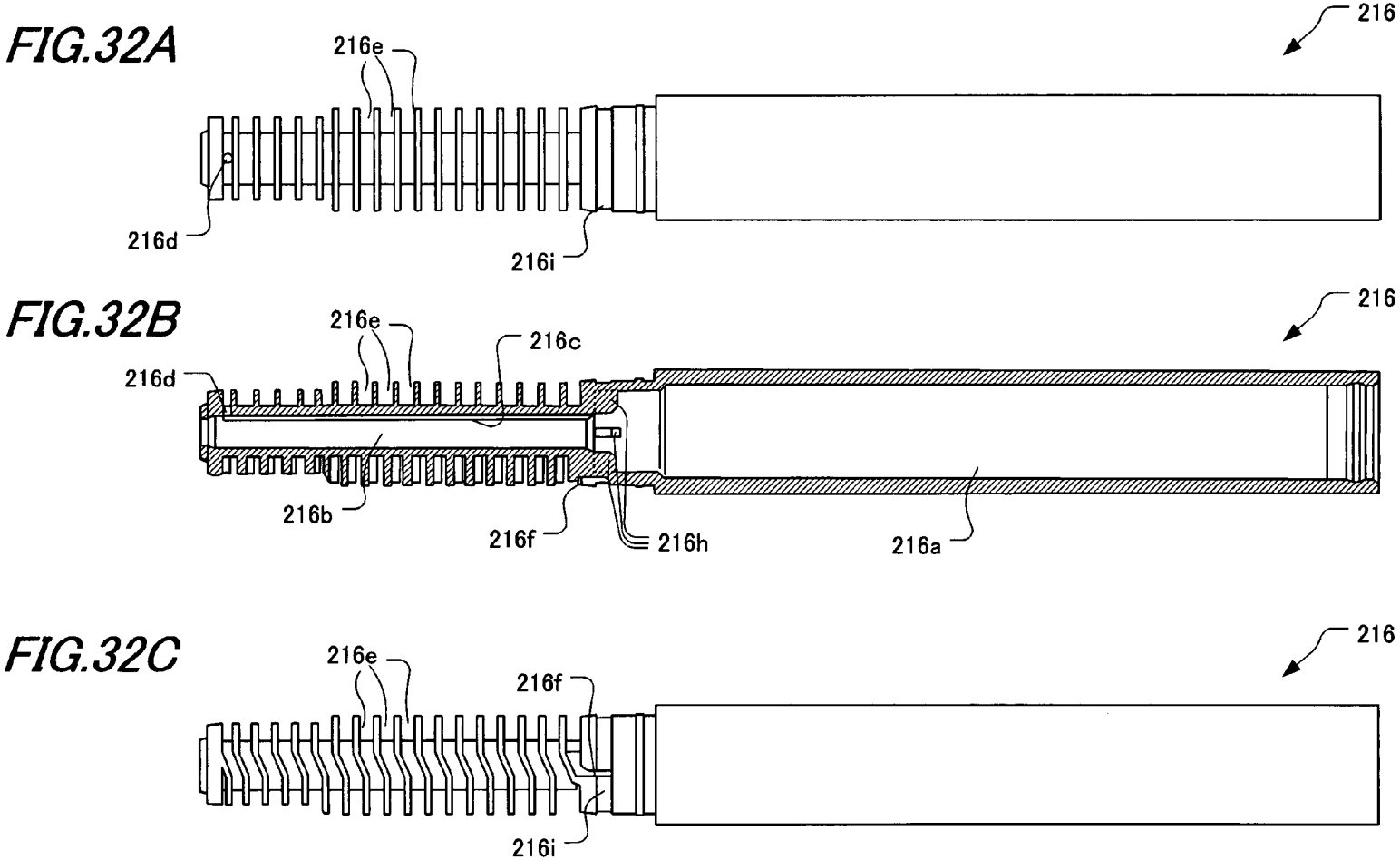
FIG. 32A through FIG. 32C, show still another example of inner cylinder constituting reservoir tank, which are respective equivalents of FIG. 25A through FIG. 25C.

The configuration of the reservoir tank 228 is not limited to a single spiral passage formed of the spiral groove 216*e* shown in FIGS. 25, but it can as well use a shape in which, as shown in FIGS. 30, the groove 216*e* proceeds one way in the axial direction while reciprocating in the circumferential direction in the outer circumferential face. Alternatively, as shown in FIGS. 31, it is also possible to use a shape in which many annular grooves 216*e* are formed and the liquid and air groove (or air flow port) 216*f* which extends linearly connecting those annular grooves 216*e* is further formed. In the reservoir tank 228 in this case, as there is a single liquid and air groove 216*f* constituting a one-way passage, similar operations can be achieved without letting any liquid-air exchange to occur. It is further possible to configure a single spiral passage formed of a spiral groove 216*e* as shown in FIGS. 32.

(Seventh Preferred Embodiment)

Figure 33:
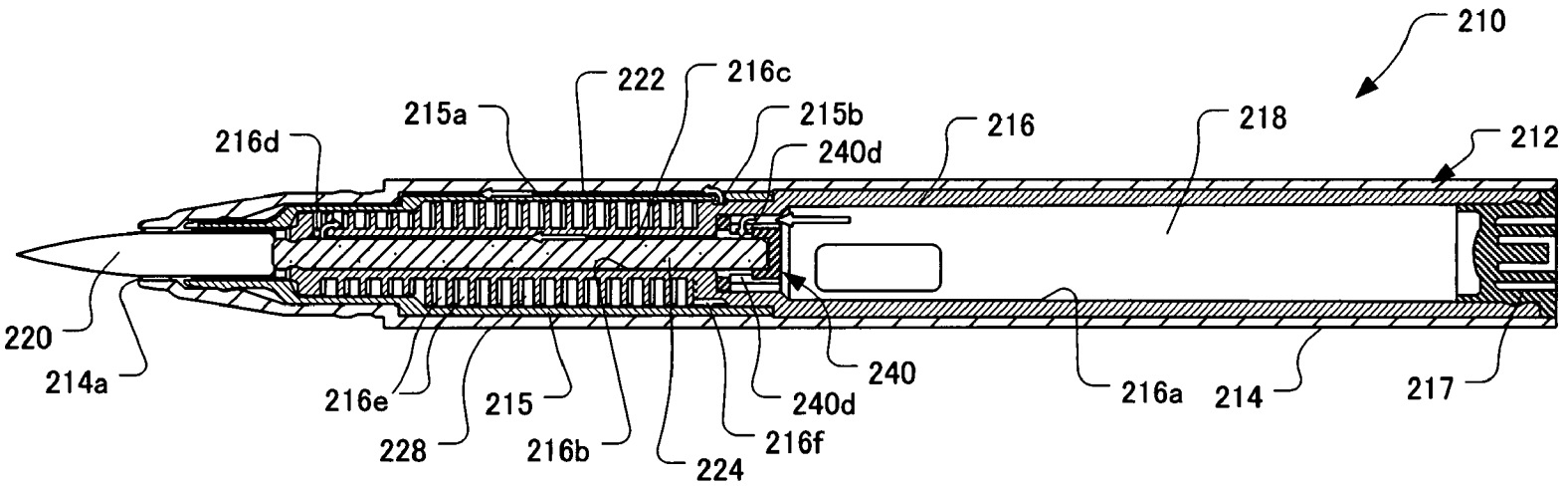
FIG. 33 shows a longitudinal section of a liquid container according to a seventh preferred embodiment of the invention, in a state of being removed a cap.
Figure 34B:
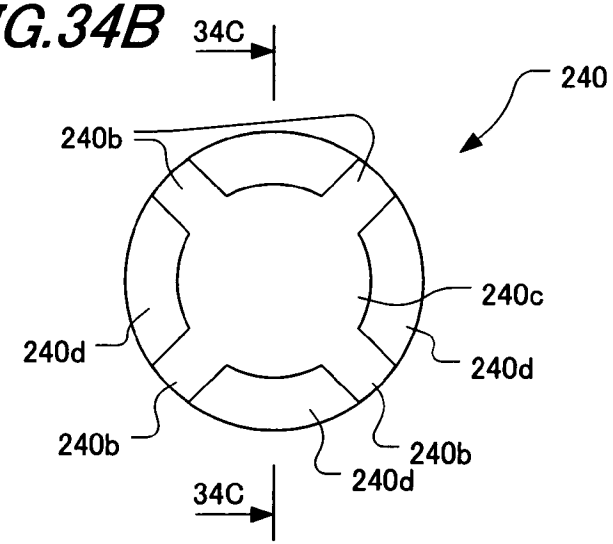
FIG. 34A shows a plan, FIG. 34B, a view in the direction of arrow 34B in FIG. 34A, and FIG. 34C, a section along line 34C—34C in FIG. 34B of a plug to be used in the seventh preferred embodiment.
Figure 34A:
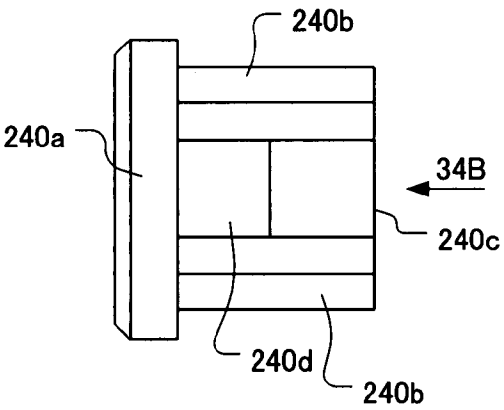
Figure 34C:
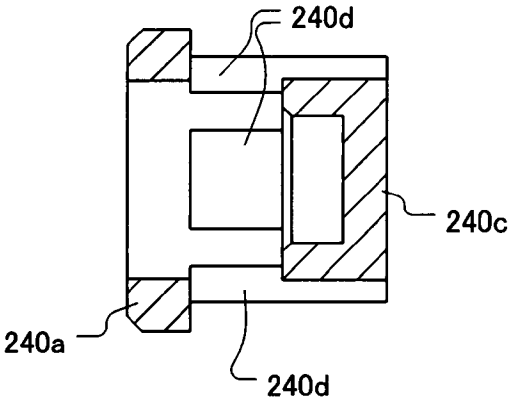

FIG. 33 shows a longitudinal section of a liquid container according to a seventh preferred embodiment of the invention. This embodiment differs from the sixth preferred embodiment in that the rear end part of the junction core 224 extends farther toward the main tank 218 than in the sixth preferred embodiment, and a plug 240 is fitted to that extended rear end part. The plug 240, as shown in FIGS. 34, has a flange 240*a*, a plurality of (four) pillars 240*b* extending backward from the flange 240*a*, a bottom 240*c* to which the rear end of each of the pillars 240*b* is connected, and openings 240*d* formed between adjoining pillars 240*b*.

This plug 240 prevents the junction core 224 from coming into direct contact at the rear end with the liquid in the main tank 218, but the liquid in the main tank 218 flows to the guiding portion via the openings 240*d* formed in the flanks of the plug 240. In this way, the gravity of the liquid in the main tank 218 is prevented from directing acting on the junction core 224, and the liquid is prevented even more securely from undesirably flowing to the pen nib 220 via the junction core 224.

(Eighth Preferred Embodiment)

Figure 35:
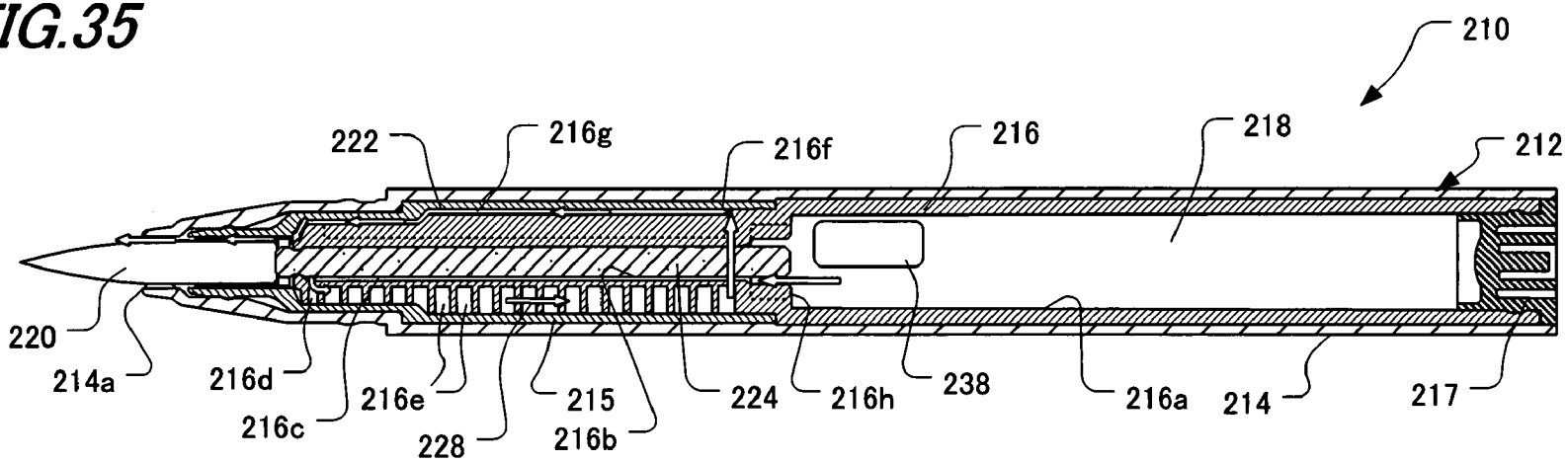
FIG. 35 shows a longitudinal section of a liquid container according to an eighth preferred embodiment of the invention, in a state of being removed a cap.
Figure 36A:
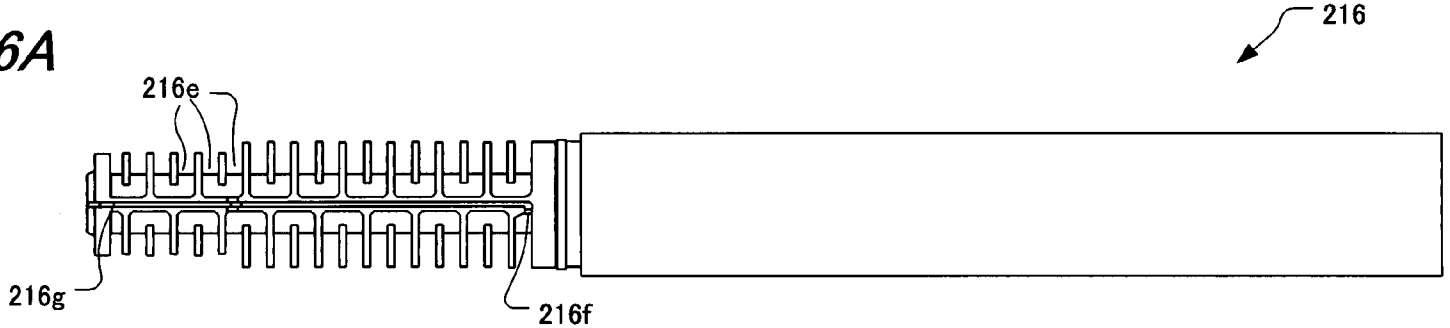
FIG. 36A through FIG. 36C, show an inner cylinder to be used in the eighth preferred embodiment, which are respective equivalents of FIG. 25A through FIG. 25C.
Figure 36B:
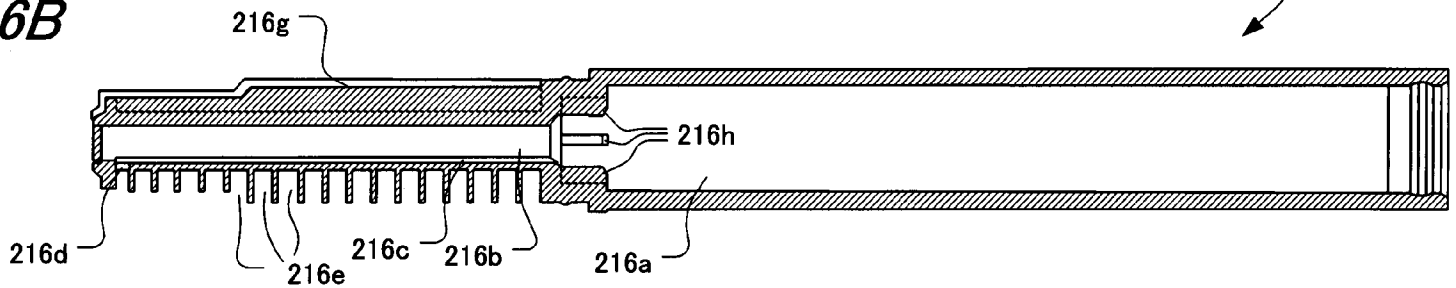
Figure 36C:
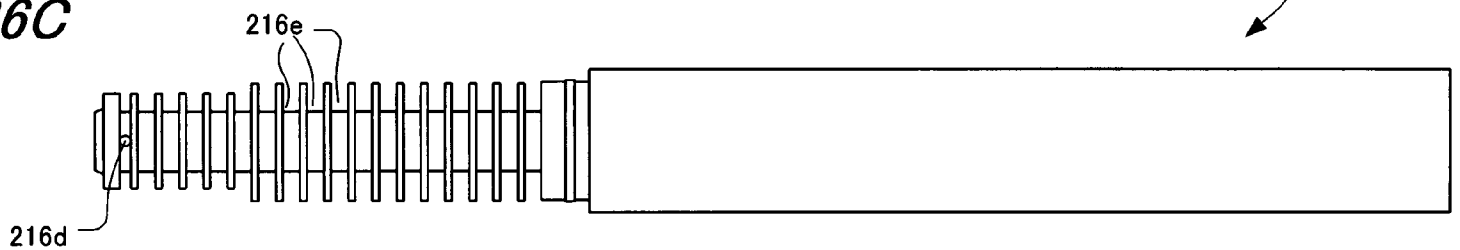

FIG. 35 shows a longitudinal section of a liquid container according to an eighth preferred embodiment of the invention. This embodiment differs from the sixth preferred embodiment in that while the air passage 222 is formed between the outer circumferential face of the intermediate cylinder 215 and the inner circumferential face of the outer cylinder 214 in the sixth preferred embodiment, in this eighth preferred embodiment the air passage 222 is formed between the outer circumferential face of the inner cylinder 216 and the inner circumferential face of the intermediate cylinder 215. For this reason, in the inner cylinder 216, as shown in FIGS. 36, an air groove 216*g* is formed, which extends in the axial direction to a different position in the circumferential direction from that of the groove 216*e* and communicates with the air flow port 216*f*, and the air groove 216*g* and the inner circumferential face of the intermediate cylinder 215 constitute the air passage 222. The groove 216*e* proceeds in the axial direction while reciprocating in the outer circumferential face in the circumferential direction without crossing the air groove 216*g*. The air groove 216*g* constituting the air passage 222 and the groove 216*e* constituting the reservoir tank 228 do not communicate directly with each other but only via the air flow port 216*f*.

This preferred embodiment, can provide operations similar to those of the sixth preferred embodiment. When surplus overflowing liquid is stored in the reservoir tank 228, air in the reservoir tank 228 is discharged via the air passage 222.

Figure 42:
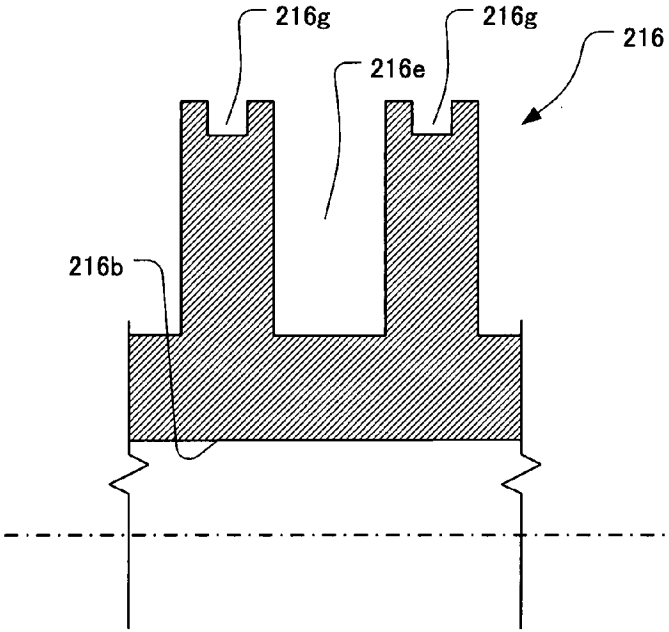
FIG. 42 shows a part of an inner cylinder, which is an example of modification of the eighth preferred embodiment.

Although the air groove 216*g* in this preferred embodiment extends to a different position in the circumferential direction from the groove 216*e*, it is also possible, as a modification of this embodiment, to form the air groove 216*g* in the circumferential face of a spiral wall, formed between each groove 216*e* and the adjoining groove 216*e* in order to configure the groove 216*e* spirally (see FIG. 42). The air groove 216*g* will then spirally extent in parallel to, but will not cross, the groove 216*e*. In this way, the shape of the outer circumferential face of the inner cylinder 216 need not be differentiated in shape, which means an advantage in molding as well.

(Ninth Preferred Embodiment)

Figure 37:
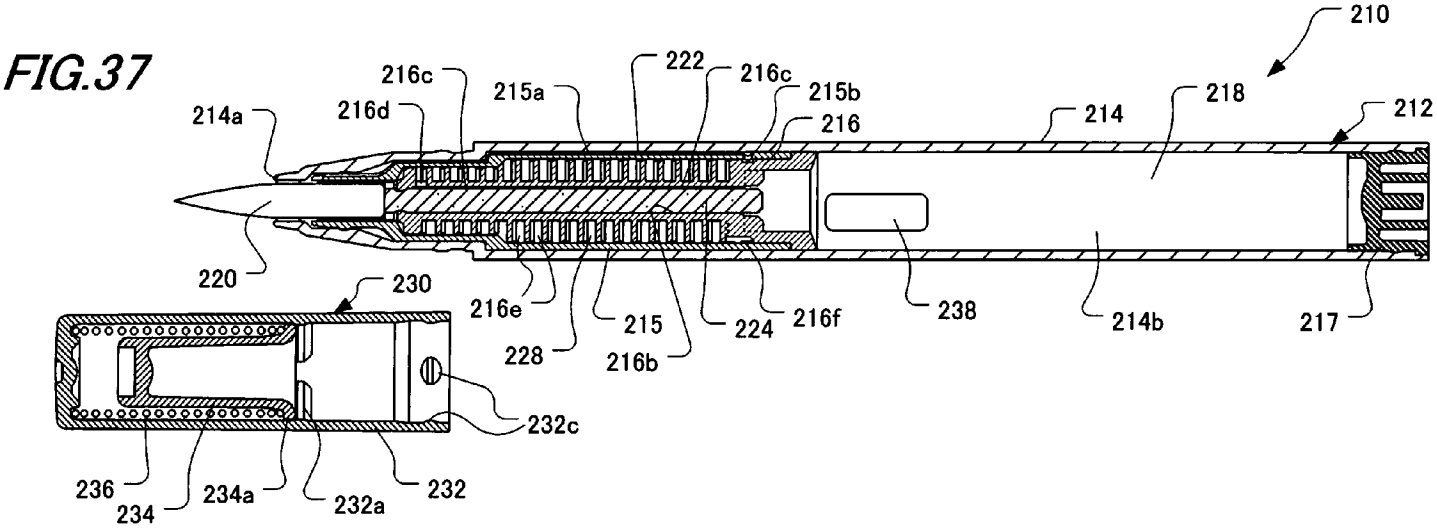
FIG. 37 shows a longitudinal section of a liquid container according to a ninth preferred embodiment of the invention, in a state of being removed a cap.

FIG. 37 shows a longitudinal section of a liquid container according to a ninth preferred embodiment of the invention. This embodiment differs from the sixth preferred embodiment in the configuration of the body 212. Instead of composing the main tank 218 of the inner cylinder 216, part of an internal space 214*b* in the rear part of the outer cylinder 214, together with the tail stopper 217, constitutes the main tank. Further, the inner cylinder 216 extends from the tip part of the outer cylinder 214 to midway in the back-and-forth directions, and the rear end part of the inner cylinder 216 is in tight contact with the outer cylinder 214 to maintain the air-tightness of the main tank 218. This ninth preferred embodiment, can provide operations similar to those of other preferred embodiments.

(Tenth Preferred Embodiment)

Figure 38:
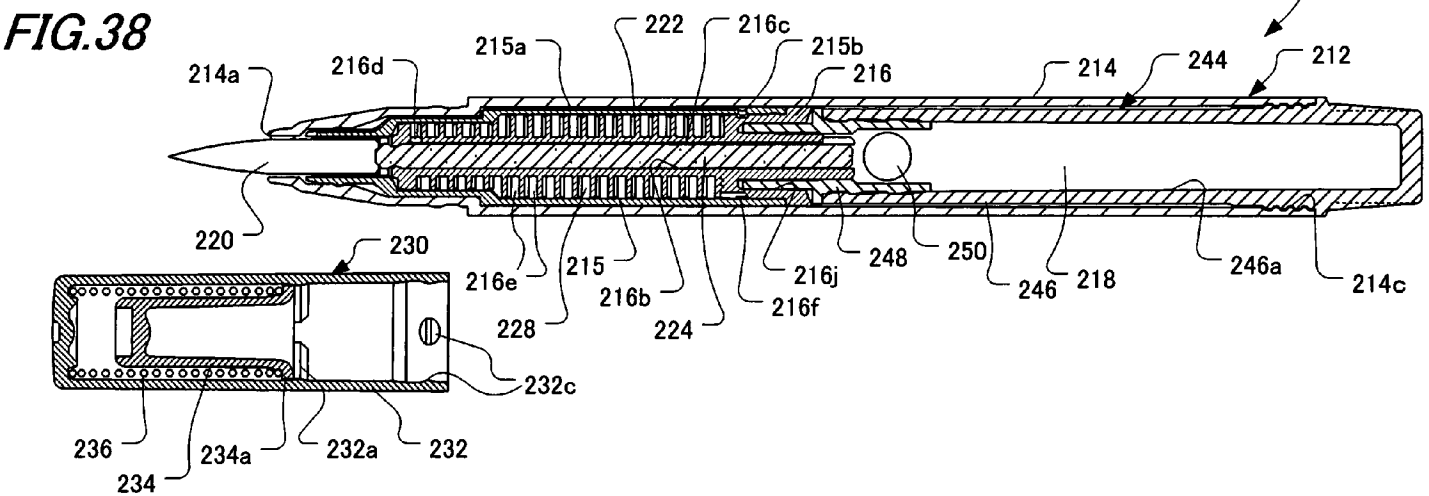
FIG. 38 shows a longitudinal section of a liquid container according to a tenth preferred embodiment of the invention, in a state of being removed a cap.
Figure 39:
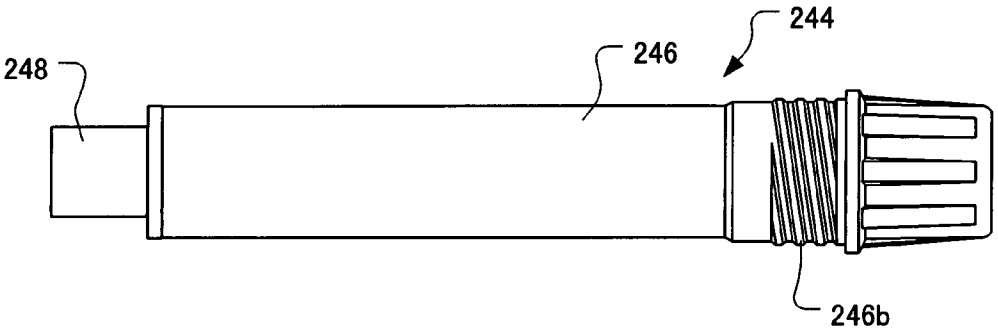
FIG. 39 shows an overall view of a cartridge to be used in the tenth preferred embodiment.

FIG.38 shows a longitudinal section of a liquid container according to a tenth preferred embodiment of the invention. In this embodiment, the configuration of the body 212 differs from that in the sixth preferred embodiment. Instead of composing the main tank 218 of the inner cylinder 216, the main tank 218 is configured in a cartridge type, comprising a cartridge 244 detachable from the inner cylinder 216 and the outer cylinder 214. The inner cylinder 216 extends from the tip part of the outer cylinder 214 to midway in the back-and-forth directions, and the rear end part of the inner cylinder 216 is in tight contact with the outer cylinder 214.

Though the cartridge 244 can be configured in any desired manner, the cartridge 244 in this example, as shown in FIG. 37, comprises a cartridge body 246 and a tip plug 248, and an internal space 246*a* of the cartridge body 246 constitutes the main tank 218. On the rear outer circumferential face of the cartridge body 246 is formed a male thread 246*b* to engage with a female thread 214*c* formed in the rear end of the inner circumferential face of the outer cylinder 214, and the cartridge body 246 is screwed into the outer cylinder 214. The tip of the tip plug 248 is inserted into an annular groove 216*j* formed in the read end of the inner cylinder 216. When the cartridge 244 is still unused, a stirring ball 250 blocks the opening in the tip plug 248 to serve as a seal cap. Once the cartridge 244 is connected to the inner cylinder 216, the stirring ball 250 detaches itself from the inner circumferential face of the tip plug 248, and is inserted into the main tank 218 to perform the role of stirring the liquid in the main tank 218. This tenth preferred embodiment can provide operations similar to those of other preferred embodiments.

(Eleventh Preferred Embodiment)

Figure 40:
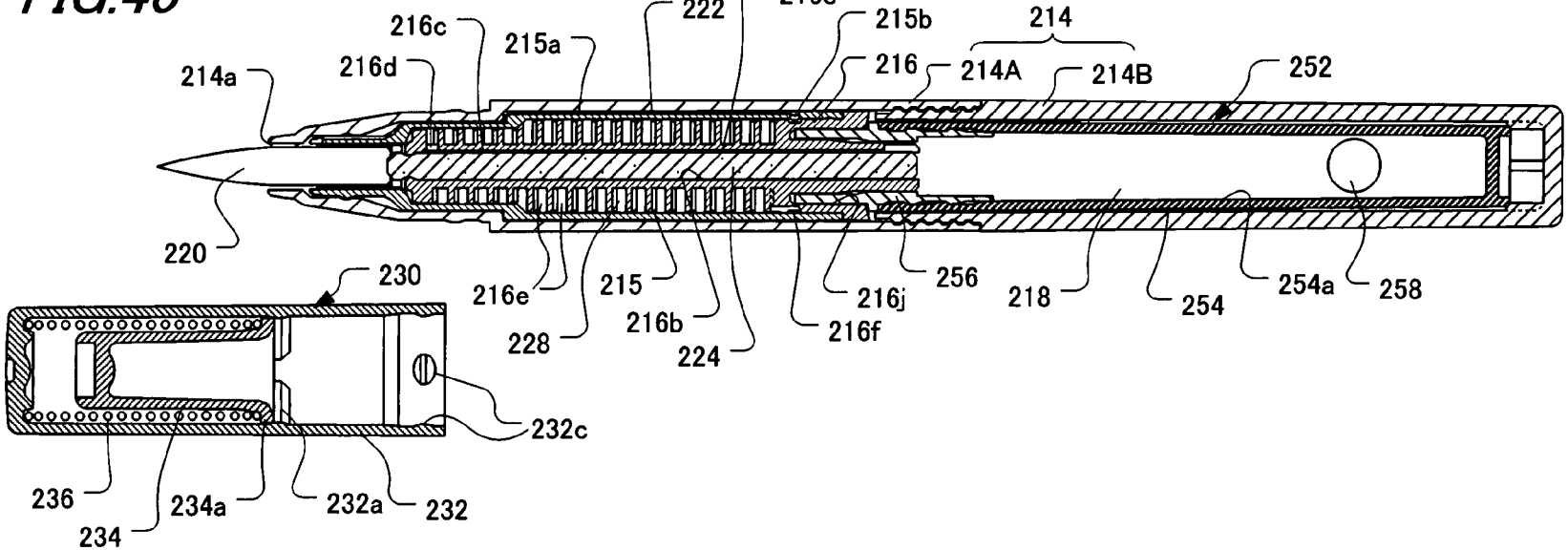
FIG. 40 shows a longitudinal section of a liquid container, which is an eleventh preferred embodiment of the invention, in a state of being removed a cap.
Figure 41:
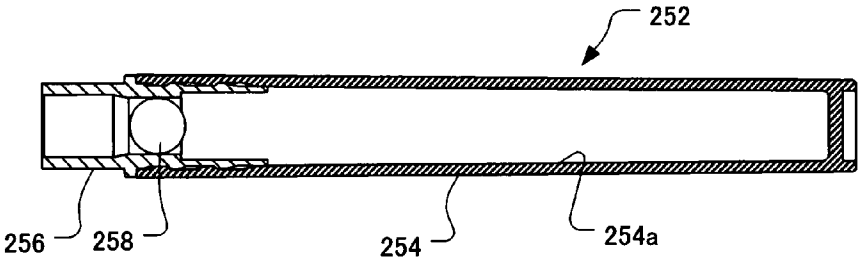
FIG. 41 shows a longitudinal section of a cartridge to be used in the eleventh preferred embodiment.

FIG. 40 shows a longitudinal section of a liquid container according to an eleventh preferred embodiment of the invention. This embodiment also has a cartridge type configuration. A cartridge 252, as shown in FIG. 41, comprises a cartridge body 254 and a tip plug 256, and an internal space 254*a* of the cartridge body 254 constitutes the main tank 218.

Furthermore, the outer cylinder 214 is composed of a front outer cylinder 214A and a rear outer cylinder 214B to be screwed onto each other, and the cartridge 252 can be connected to an inner cylinder 216 in a state in which the rear outer cylinder 214B is detached from the front outer cylinder 214A, and the tip of the tip plug 256 is inserted into the annular groove 216*j* formed in the rear end of the inner cylinder 216. Into the internal space 254*a* of the cartridge body 254 is inserted a stirring ball 258. When the cartridge 252 is still unused, the stirring ball 258 blocks the opening in the tip plug 256 to serve as a seal cap. Once the cartridge 252 is connected to the inner cylinder 216, the stirring ball 258 detaches itself from the inner circumferential face of the tip plug 256, and is inserted into the main tank 218 to perform the role of stirring the liquid in the main tank 218.

This eleventh preferred embodiment can provide operations similar to those of other preferred embodiments.

(Twelfth Preferred Embodiment)

Figure 43:
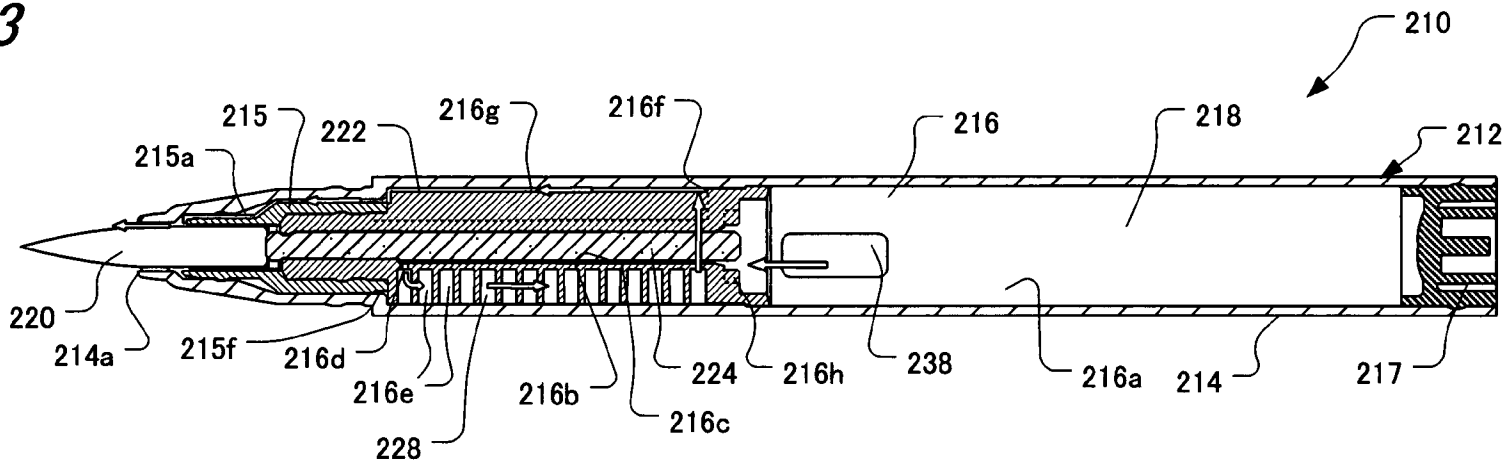
FIG. 43 shows a longitudinal section of a liquid container according to a twelfth preferred embodiment of the invention, in a state of being removed a cap.

FIG. 43 shows a longitudinal section of a liquid container according to a twelfth preferred embodiment of the invention. This embodiment is a modification of the eighth preferred embodiment. The air passage 222 in the eighth preferred embodiment is arranged in substantially the same position in the radial direction of the groove 216*e*, instead of outside the radial direction. In this twelfth preferred embodiment the same configuration is used. Furthermore, the intermediate cylinder 215 is shortened, and the air passage 222 is composed of the air groove 216*g* in the inner cylinder 216, the inner circumferential face of the outer cylinder 214, the air groove 215*a* of the intermediate cylinder 215, and the inner circumferential face of the outer cylinder 214. Additionally, in order to establish communication between the air groove 216*g* and the air groove 215*a*, an annular groove 215*f* is formed in the rear end part of the air groove 215*a* of the intermediate cylinder 215, and the positioning between the inner cylinder 216 and the intermediate cylinder 215 in the circumferential direction is made dispensable by establishing communication between the air groove 216*g* and the air groove 215*a* via the annular groove 215*f*. This preferred embodiment can provide the same operation as the eighth preferred embodiment.

(Thirteenth Preferred Embodiment)

Figure 44:
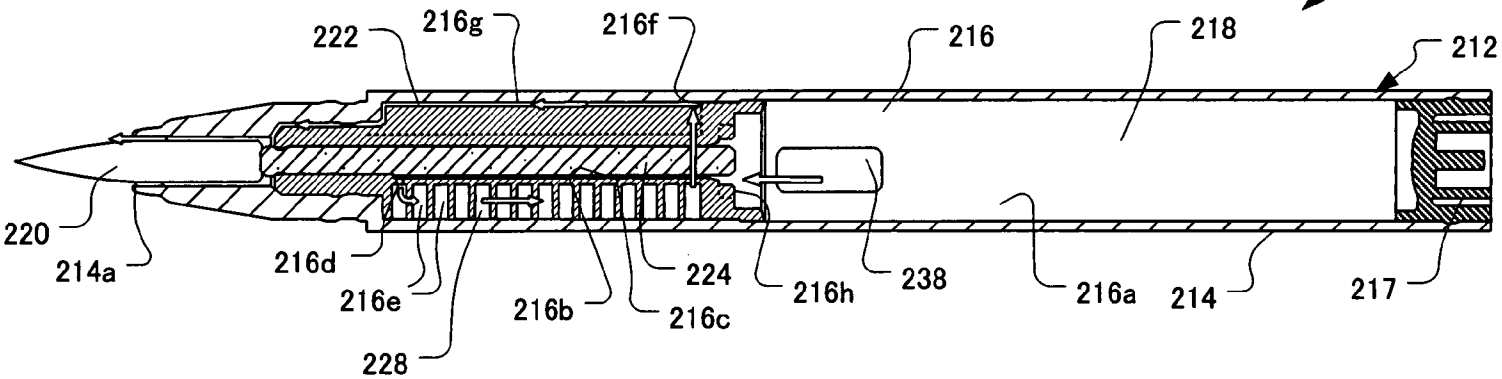
FIG. 44 shows a longitudinal section of a liquid container according to a thirteenth preferred embodiment of the invention, in a state of being removed a cap.

FIG. 44 shows a longitudinal section of a liquid container according to a thirteenth preferred embodiment of the invention. This embodiment, like the twelfth preferred embodiment, is a modification of the eighth preferred embodiment. In this thirteenth preferred embodiment, the intermediate cylinder 215 is completely omitted, and the air passage 222 is configured of the air groove 216*g* in the inner cylinder 216 and the inner circumferential face of the outer cylinder 214. In this case, the base of the pen nib 220 can be fixed directly to the outer cylinder 214, not to the intermediate cylinder 215. This embodiment can provide the same operation as the eighth preferred embodiment and, moreover, permits a reduction in the number of components.

While the invention has been described in terms of several preferred embodiments, those skilled in the art will recognize that the invention can be practiced with modification within the spirit and scope of the appended claims.

What is claimed is:

1. A liquid container comprising:

a body comprising a main tank in which liquid is stored;

a supply outlet positioned at a tip of the body for supplying the liquid;

a guiding portion connecting the main tank and the supply outlet to guide the liquid from the main tank to the supply outlet; and a liquid reservoir having an air flow part communicating with an outside, a liquid flow port communicating with one of the main tank and the guiding portion, and a reservoir tank for accumulating the liquid overflowing the main tank, wherein said reservoir tank stores the liquid on a side farther away from the supply outlet than said liquid flow port, wherein the reservoir tank of said liquid reservoir is arranged outside in a radial direction of the main tank, and wherein said reservoir tank comprises a single passage extending from the liquid flow port to the air flow port.

2. The liquid container according to claim 1, wherein the liquid flow port of said liquid reservoir is arranged on a side of the supply outlet from a connecting point between the main tank and the guiding portion.

3. The liquid container according to claim 1, wherein said main tank communicates with the external atmosphere only via the air flow port, the reservoir tank and the liquid flow port of said liquid reservoir.

4. The liquid container according to claim 1, wherein said passage has a spiral shape.

5. The liquid container according to claim 1, wherein said passage proceeds in the axial direction while reciprocating in circumferential directions.

6. The liquid container according to claim 1, wherein the air flow port communicates with the exterior via an air passage and through an opening provided adjacent to the supply outlet.

7. The liquid container according to claim 6, wherein the air passage is arranged farther outside said reservoir tank in the radial direction.

8. The liquid container according to claim 1, wherein the body has an outer cylinder and an inner cylinder concentrically arranged within the outer cylinder, and a groove formed on the outer circumferential face of the inner cylinder constitute said reservoir tank.

9. The liquid container according to claim 8, wherein the body further has an intermediate cylinder concentrically arranged between the outer cylinder and the inner cylinder, and a gap formed between the outer circumferential face of the intermediate cylinder and the inner circumferential face of the outer cylinder constitutes an air passage connecting said air flow port and an exterior.

10. The liquid container according to claim 8, wherein a groove formed on the outer circumferential face of said inner cylinder not crossing the groove to be constituted the reservoir tank constitute an air passage connecting said air flow port and an exterior.

11. The liquid container according to claim 10, wherein the inner circumferential face of said outer cylinder and the grooves on said inner cylinder constitute said reservoir tank, and a linear groove formed on the outer circumferential face of the inner cylinder constitute an air passage connecting said air flow port and the exterior.

12. The liquid container according to claim 1, wherein said body has an inner cylinder, an intermediate cylinder on an outer circumferential side of the inner cylinder and an outer cylinder on an outer circumferential side of the intermediate cylinder, an inner circumferential face of said intermediate cylinder and an outer circumferential face of said inner cylinder constitute said reservoir tank, and a gap formed between an outer circumferential face of the intermediate cylinder and an inner circumferential face of the outer cylinder constitutes the air passage connecting the air flow port and an exterior.

13. The liquid container according to claim 8, wherein at least part of an internal space of the inner cylinder constitutes said main tank.

14. The liquid container according to claim 8, wherein at least part of an internal space of the outer cylinder constitutes said main tank.

15. The liquid container according to claim 8, wherein said main tank is composed of a cartridge detachably connected to part of the body.

16. The liquid container according to claim 8, wherein components containing the inner cylinder and positioned within the outer cylinder are inserted from the rear end of the outer cylinder and fitted within.

17. The liquid container according to claim 1, wherein a second reservoir tank is provided facing said guiding portion.

18. The liquid container according to claim 17, wherein said second reservoir tank is formed in a shape permitting accommodation of liquid or of a liquid holding member capable of absorbing liquid.

19. The liquid container according to claim 17, wherein said second reservoir tank communicates with the external atmosphere by a second air passage.

* * * * *